US007267119B2

(12) United States Patent
Maeda et al.

(10) Patent No.: US 7,267,119 B2
(45) Date of Patent: Sep. 11, 2007

(54) AIR GUN

(75) Inventors: Tetsuo Maeda, Tokyo (JP); Yoshiyuki Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 393 days.

(21) Appl. No.: 11/024,479

(22) Filed: Dec. 30, 2004

(65) Prior Publication Data

US 2006/0162711 A1 Jul. 27, 2006

(51) Int. Cl.
*F41B 11/00* (2006.01)

(52) U.S. Cl. ..... 124/73; 124/74; 124/76

(58) Field of Classification Search ..... 124/73, 124/74, 76, 82
See application file for complete search history.

(56) References Cited

U.S. PATENT DOCUMENTS 2,817,328 A 12/1957 Gale
5,476,087 A 12/1995 Kunimoto
6,026,797 A * 2/2000 Maeda et al. ..... 124/74

* cited by examiner

*Primary Examiner*—Michael J. Carone
*Assistant Examiner*—Gabriel J. Klein
(74) *Attorney, Agent, or Firm*—Rader, Fishman & Grauer PLLC

(57) ABSTRACT

An air gun including a slide, a barrel, a cylinder portion, a hit pin, a hollow valve pin chamber, a valve body, a gas supply port, a valve pin, a pressing section, a bullet feed nozzle link connected to a trigger; and a bullet feed nozzle. When the hit pin is pressed to the muzzle side and made to slide to the muzzle side, the valve pin slides to the muzzle side against an urging force to release an airtight state between the valve pin flange section and the gun rear end side side surface of the valve pin chamber; compressed gas supplied to the valve pin chamber from the gas supply port is supplied from between the valve pin chamber gun rear end side side surface and the valve pin flange section to the valve pin chamber side opening; and a bullet is fired from the muzzle by passing compressed gas through the bullet feed nozzle insertion section a supplying to the muzzle side of the bullet feed nozzle; and compressed gas is supplied from a clearance between the pressing section and through holes into which the pressing section is inserted to the gun rear end side to cause the cylinder section to move to the gun rear end side.

1 Claim, 24 Drawing Sheets

AIR GUN

BACKGROUND OF THE INVENTION

1. Field of the Invention

The present invention relates to an air gun for firing bullets using supplied compressed gas, and for carrying out blowback in order to move a slide towards the rear of the gun to fire the next bullet.

2. Description of the Related Art

With a related art air gun for carrying out blowback in order to shoot the next bullet, supply of compressed gas to the air gun for shooting the bullet using the compressed gas is carried out by a gun comprised of a compressed gas chamber for storing compressed gas, an opening and closing valve for carrying out release of compressed gas in order to fire a bullet, and a switching valve for switching a discharge destination for compressed gas supplied by opening the opening and closing valve, the opening and closing valve being provided inside a handle and opened by striking a valve rod on a hammer to supply compressed gas inside the compressed gas chamber, the switching valve being provided in a slider section or handle and switching the discharge destination of the compressed gas supplied by opening the opening and closing valve.

That is, an automatic air gun of the related art that uses compressed carbon dioxide gas or air is known, for example, such as the air gun shown in FIG. 22 (related art 1).

Related art one, which is an air gin of the related art, will be described in the following. Numeral 401 indicates an air gun. Operation of the air gun 401 will be described in the following, but up to where a bullet W is supported inside a rubber chamber 408 and the bullet W itself fired, from a state where an exchange valve 409 is moved to the rear of the air gun 401 against urging force of a valve spring 412 will be described. First of all, a trigger 402 for firing the bullet W is pulled. In doing so, a hammer 403 rotates in the direction shown by an arrow, and presses down a valve pin 404. By pressing down the valve pin 404 the valve 406 is opened, compressed gas stored in an accumulator chamber 405 passes through the valve 406 and flows to the slide 407 side. The exchange valve 409 at this time blocks off a cylinder 413 side so that no compressed air flows out to the cylinder 413 side.

Compressed gas that flows in to the slide 407 side flows in to the side of a bullet W inside the rubber chamber 408, pressing the bullet W out, passing through the inside of an outer barrel 410 to be fired with force from the muzzle.

After firing the bullet W, since there is no longer a bullet W in the rubber chamber 408 the exchange valve 409 is pressed back to the muzzle side (not shown in the drawing) by the force of the valve spring 412, flowing out of compressed gas to the muzzle side is prevented, and the cylinder side is opened. As a result, compressed gas that has been prevented from flowing out to the muzzle side flows to the inside of the cylinder 413, the cylinder 413 and the slide 407 are moved to the rear of the air gun 401 against the urging force of the slide spring 414, moving the hammer 403 rearwards, and when returned to the muzzle side, a muzzle side tip of the slide 407 presses the next bullet supplied from a magazine 411, loads the bullet into the rubber chamber 408, and carries out preparation for firing of the next bullet.

Also, an air gun 501 of related art 2 shown in FIG. 23 is as follows.

501 is an air gun. In the following the operation of the air gun 501 will be described, but description is from a state where a bullet W is supported inside a loading packing 508.

With this second related art, an exchange valve 509 is different from that of the first related art, and in a state where a bullet W has been loaded into the loading packing 508, it is possible for compressed gas stored in an accumulator chamber 505 to flow out to the side of a bullet W loaded in the loading packing 509 in a normal state without pressing the bullet, and no air flows out to the cylinder 513 side. Then, after firing the bullet W, in the event that compressed gas flows out rapidly to the muzzle (not shown) side, the exchange valve 509 is moved in the muzzle direction by this negative pressure, a piston block 507 side is blocked off, and the cylinder 513 is opened, moving so that compressed gas flows out to the cylinder 513 side.

First of all, the trigger 502 is pulled in order to fire the bullet W. In doing so, a hammer 503 rotates in the direction shown by the arrow, and presses a valve rod 504. The valve 506 is opened as a result of the valve rod 504 being pressed, and compressed gas stored in the accumulator chamber 505 flows through the valve 506 to a piston block 507 side. Inside the piston block 507, an exchange valve 509 puts a loading packing 508 side in an open state using urging force of a spring 512, and a side end portion of the exchange valve 509 to the rear of the air gun 501 blocks of the cylinder 513 side, which means that compressed gas that has flowed to the piston block 507 side flows to the bullet W side inside the loading packing 508, which means that the bullet W is forced out, passes inside the outer barrel 510 and is fired with force from the muzzle.

After the bullet W has been fired, since there is no longer a bullet W in the loading packing 508 compressed gas flows rapidly to the loading packing 508 side, the exchange valve 509 is pressed back to the muzzle (not shown) side against the urging force of the valve spring 512 by negative pressure generated by compressed gas flow, and outflow of compressed gas to the muzzle side is prevented. Accordingly, compressed gas that has been prevented from flowing out to the muzzle side flows to the inside of the piston block 507, the piston block 507 is moved to the rear of the air gun 501, moving the hammer 503 rearwards, and when returned to the muzzle side, a muzzle side tip of the piston block 507 presses the next bullet supplied from a magazine 511, loads the bullet into the loading packing 508, and carries out preparation for firing of the next bullet.

As described above, the air guns of related art 1 and related art 2 the next bullet is supplied by changing whether compressed gas flows from a muzzle side at an upper part of the air gun to a muzzle side inside a slide provided capable of reciprocal sliding to the rear of the gun, or flows to the rear of the gun, but an exchange valve for changing the flow path of the compressed gas is provided inside a slide capable of sliding at an upper part of the air gun.

Further, air guns of the related art using compressed gas are shown in U.S. Pat. No. 2,817,328 and U.S. Pat. No. 5,476,087. With these air guns, a valve for carrying out discharge of compressed gas in order to fire a bullet, and a mechanism for carrying out bullet loading and preparation for firing of the next bullet, exist separately.

In this way, with the related art method, an opening and closing valve for supplying compressed gas, and an exchange valve or mechanism for cutting off supply of compressed air to a bullet side after the bullet has been loaded and preparing to fire a bullet, so that compressed gas is supplied in order to move a cylinder etc. to the rear of the gun, are each provided separately.

However, with the related art method, since the opening and closing valve and the exchange valve are provided separately, there is an increase in the number of component parts, as well as it becoming difficult to miniaturize the overall structure, there is a problem that wasteful use is made of compressed gas to the extend of the volume of compressed gas passing between each of the valves, and it is difficult to unite the two to miniaturize the gun.

In view of these problems, an object of the present invention is to reduce the size of functions of an opening and closing valve and an exchange valve to improve compressed gas usage efficiency, and to enable miniaturization of an air gun.

The inventors of this application have also invented an air gun (related art 3) as described in the following, to solve the above described problems of the related art, and acquired a patent, namely U.S. Pat. No. 6,026,797, which was applied for in America on Sep. 25, 1998.

American patent No. 6,026,797 shown in FIG. 24 will be described in the following.

The air gun of U.S. Pat. No. 6,026,797 can provide a valve that is compact in function and improves usage efficiency of compressed gas. To achieve this, the air gun is constructed with a hit pin arranged in a cylinder portion, a valve body arranged within a hollow portion of the cylinder portion and having a bullet supplying nozzle chamber and a valve pin chamber, a gas inlet port opened to a sleeve-shaped circumferential face of the valve pin chamber, a bullet supplying nozzle arranged within the bullet supplying nozzle chamber, and a valve pin arranged within the valve pin chamber. The hit pin is pressed on a muzzle side and the valve pin is made to slide to the muzzle side so that an air-tight state between a valve pin flange portion and a side face of the valve pin chamber on its gun rear end side is released. A compressed gas is supplied to a nozzle chamber side opening and a valve pin chamber side opening from a clearance between the valve pin flange portion and the gun rear end side face of the valve pin chamber.

However, the air gun of related art 3 is operated by compressed gas, and compressed gas starts to cause the slider to retreat before compressed gas starts to cause the bullet to move inside the barrel. Therefore, start of movement of the bullet and firing are delayed more than retreating movement of the slide. Because of this slide retreating, it is easy for the valve to move up and down, particularly in a downward direction, and there is a problem that shooting precision is lowered.

Also, the air gun of related art 3 causes operation of a bullet supply nozzle using high pressure compressed gas, and as a result of repeating this operation there may be occasions when problems with durability arise.

SUMMARY OF THE INVENTION

The object of the present invention is to improve shooting precision by causing a bullet to be fired before retreating of the slide commences, which is a problem in related art 3.

An air gun of the present invention comprises:

a slide, provided in an upper part of a gun, capable of sliding parallel to a barrel;

a cylinder portion, formed of a cylinder that is open at a muzzle side and closed off a gun rear end side, fixed to a gun rear end side of the slide;

a hit pin provided projecting from a hollow inner portion of the cylinder portion to a gun rear end side, and capable of sliding in a nozzle direction;

a hollow valve pin chamber fixed to the gun body so as to be positioned in the hollow inner portion of the cylinder portion;

a valve body having a through hole passing through from a muzzle side to a gun rear end side at a smaller diameter than the valve pin chamber;

a gas supply port, opened to a cylindrical peripheral surface of the valve pin surface, for normally supplying compressed gas to the valve pin chamber of the valve body;

a valve pin, formed as a cylinder, provided inside the valve pin chamber, urged normally to the gun rear end side and having a bullet supply nozzle insertion section formed at a muzzle side, and inserted into the muzzle side through holes of the valve pin chamber to project, and a pin body having a valve pin flange section, capable of sliding in an air-tight state with the muzzle side through hole of the valve pin chamber, and contacting a gun rear end side surface of the valve pin in an air-tight manner at the gun rear end side, the valve pin communicating with a muzzle side providing a valve pin chamber side opening that opens to a pin body side surface at a muzzle side of a pressing section provided in the pin body;

a pressing section, provided at a gun rear end side of the pin body, fixed to the valve body, inserted into rear end side through holes of the valve pin to project, positioned so that a tip end of a gun rear side is adjacent to the hit pin, and capable off passing compressed gas from a clearance between the rear end side through holes;

a bullet feed nozzle link connected to a trigger; and a bullet feed nozzle, formed as a cylinder, inserted into a bullet nozzle insertion section of a valve pin nozzle side projecting to a nozzle side of the valve pin chamber, forming a rib-shaped bullet feed nozzle link engagement projection for engaging with the bullet feed nozzle link at an outer periphery of a gun rear end side, and being capable of sliding in the valve pin muzzle side bullet feed nozzle insertion section in order to load a bullet in the chamber in response to movement of the trigger and the bullet feed nozzle link, wherein when the hit pin is pressed to the muzzle side and made to slide to the muzzle side, the valve pin slides to the muzzle side against urging force to release an airtight state between the valve pin flange section and the gun rear end side side surface of the valve pin chamber, compressed gas supplied to the valve pin chamber from the gas supply port is supplied from between the valve pin chamber gun rear end side side surface and the valve pin flange section to the valve pin chamber side opening, and a bullet is fired from the muzzle by passing compressed gas through the bullet feed nozzle insertion section a supplying to the muzzle side of the bullet feed nozzle, and compressed gas is supplied from a clearance between the pressing section and through holes into which the pressing section is inserted to the gun rear end side to cause the cylinder section to move to the gun rear end side.

Alternatively, as another embodiment of an air gun, the cylinder section is provided within a gun rear end side of the slide capable of free movement, and there is no hit pin.

DESCRIPTION OF PREFERRED EMBODIMENTS

Figure 1:
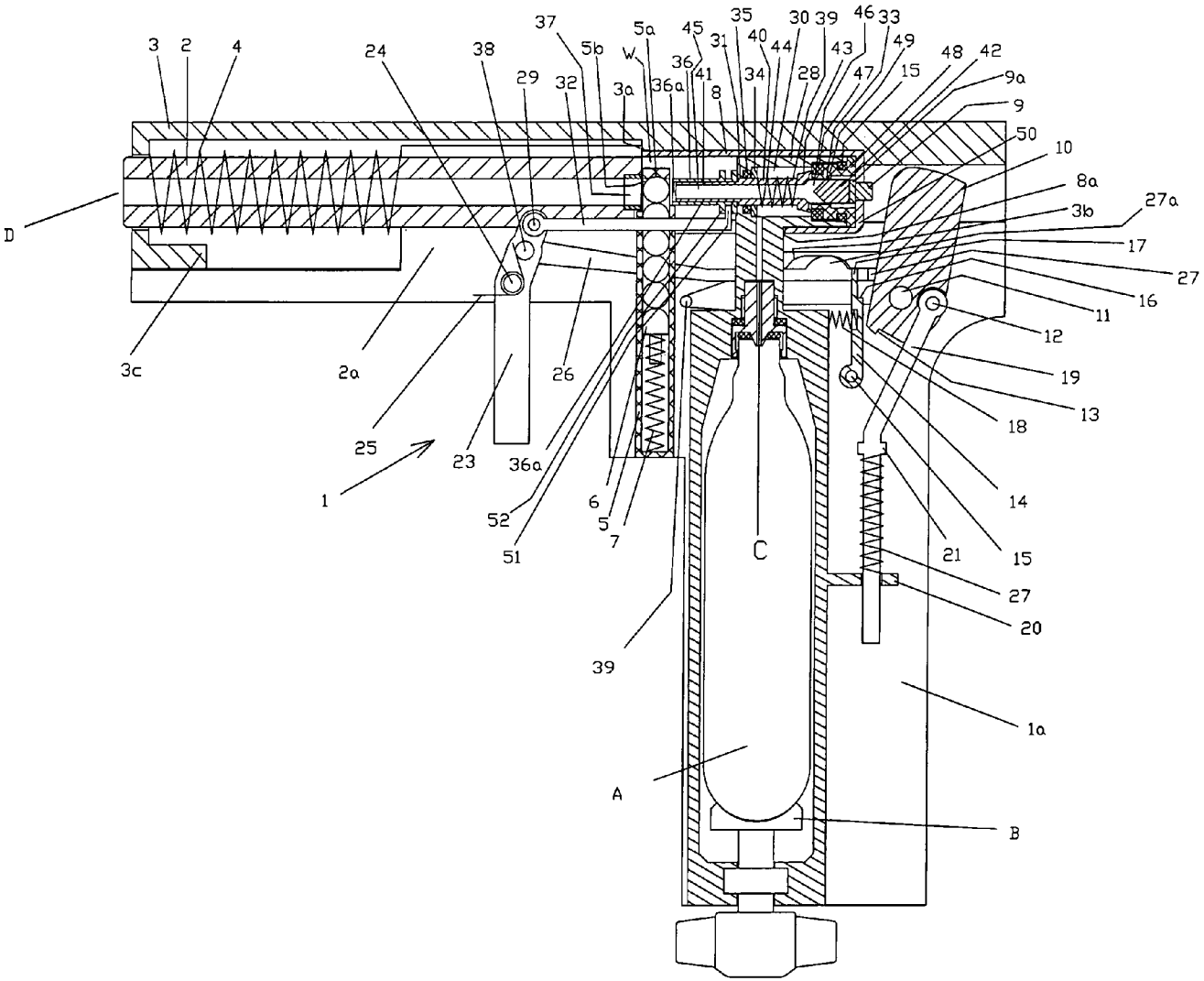
FIG. 1 is a cross sectional explanatory drawing showing an initial state of an air gun of a first embodiment of this invention.
Figure 12:
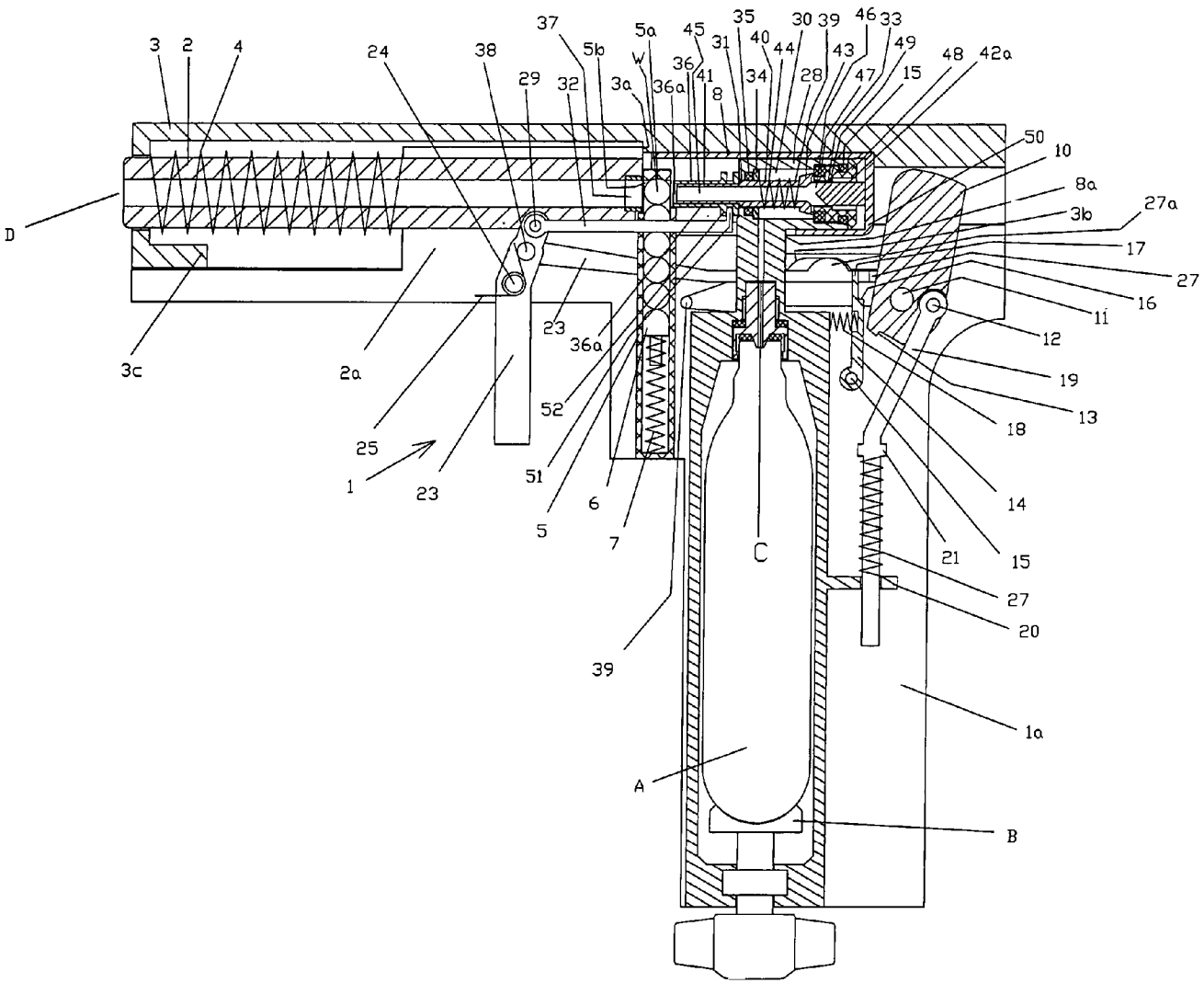
FIG. 12 is a cross section explanatory drawing showing an initial state of an air gun of a second embodiment of this invention.
Figure 13:
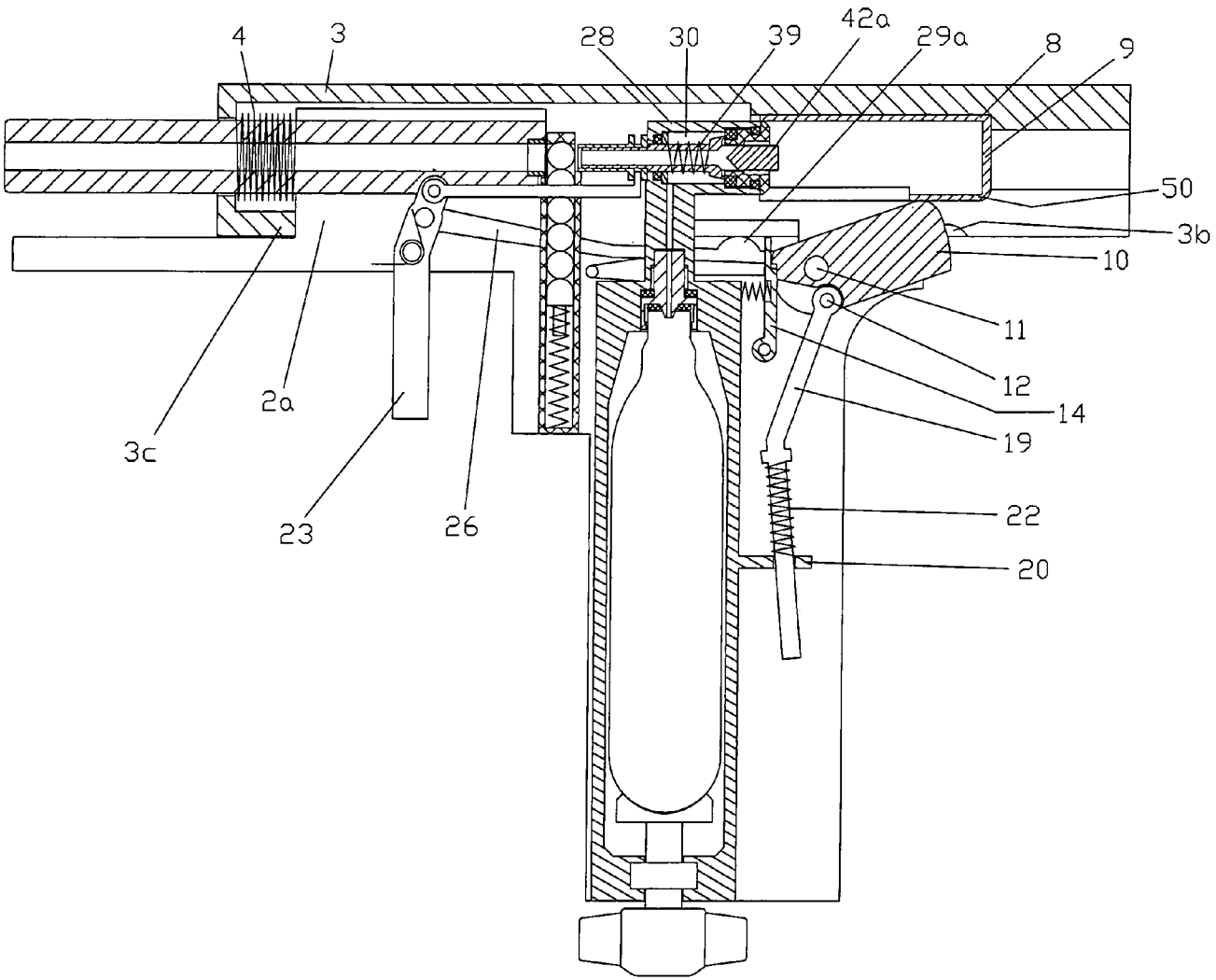
FIG. 13 is a cross sectional explanatory drawing of an operational state of the air gun of the second embodiment of this invention.

Next, embodiments of this invention will be described based on the drawings. FIG. 1 is a cross section explanatory drawing showing an initial state of an air gun of a first embodiment of this invention, FIG. 2-FIG. 10 are cross sectional explanatory drawings of operational states of the air gun of the first embodiment of this invention, and FIG. 1 is an enlarged partial cross sectional explanatory drawing of the air gun of the first embodiment of this invention. FIG. 12 is a cross sectional explanatory drawing showing an initial state of an air gun of a second embodiment of this invention, FIG. 13-FIG. 12 are cross sectional explanatory drawings of operational states of the air gun of the second embodiment of this invention.

1 is an air gun. The air gun 1 is an automatic type air gun for firing a bullet W using gas pressure of compressed carbon dioxide gas, and carrying out supply of the next bullet. With this embodiment, compressed carbon dioxide gas is used, but it is also possible to cause operation using other compressed gas such as compressed nitrogen gas or compressed air. In the following, compressed carbon dioxide is the compressed gas. Also, a handle section 1*a* is provided in a gun rear end side lower section of the body of the air gun 1. A compressed gas cylinder A for supplying compressed gas is housed inside this handle section 1*a*. The compressed gas cylinder A is fitted from under the handle section 1*a*, and by pressing upwards using a presser screw B a seal is broken using a lower tip of a gas supply port C, which will be described later, and compressed gas is supplied from the gas supply port C. With this embodiment, the structure is such that the compressed gas cylinder A is housed inside the handle section 1*a*, but it can also be fitted outside the handle section 1*a*, or alternatively constructed so that compressed gas is supplied from a compressed cylinder fitted by a user to the air gun 1 using a hose.

Numeral 2 is a barrel and 2*a* is a barrel fixing section. The barrel 2 is cylindrical in shape, is provided in a direction to the rear of the gun from a muzzle D, and has a chamber 37 provided at a gun rear end side. The barrel fixing section 2*a* is made cylindrical and capable of being inserted into and fixing the barrel 2, and is fixed to the body of the air gun 2 at a gun rear end side of the barrel 2. Therefore, the barrel 2 is fixed to the body of the air gun 1 by fixing to the barrel fixing section 2*a*.

Numeral 3 is a slide, and an opening into which the barrel 2 can be inserted is provided in a muzzle D side of the slide 3, the barrel 2 is passed through the opening to span from the muzzle D side to a gun rear end side, the opening is arranged parallel to the barrel 2 so as to envelope the barrel, and is capable of sliding in parallel along the barrel 2. Then, the slide 3 is normally urged to the muzzle D side by a slide spring 4 fitted into the barrel 2 so that one end is supported in the barrel fixing section 2*a* and the other end is supported on the muzzle side of the slide 3. Also, an engagement projection 3*a* projecting downwards is formed on an intermediate section of the slide 3 above the barrel fixing section 2*a*, and the slide 3 is controlled so as not to move to the muzzle D side from the gun rear end side of the slide 3 by engagement with the barrel fixing section. Further, an engagement indent 3*b* capable of engaging with a trigger bar, which will be described later, is provided in a lower part of a gun rear end side of the slide 3. The engagement indent 3*b* is a groove shape with gently sloping walls for releasing engagement with an engaged trigger bar 26 by sliding the trigger 23, with the trigger bar 26, which will be described later, moving away from the engagement indent 3*b* while moving downwards, and moving downwards if engagement is released. Further, a muzzle side lower section 3*c* for contacting the barrel fixing section of the slide 3 moves a specified amount to the gun rear end side is provided at a muzzle side lower section of the slide 3. As a result, in a state where the barrel fixing section 2*a* and the muzzle side lower section 3*c* are in contact, the slide 3 is in a state moved as far as possible to the gun rear end side.

Figure 11:
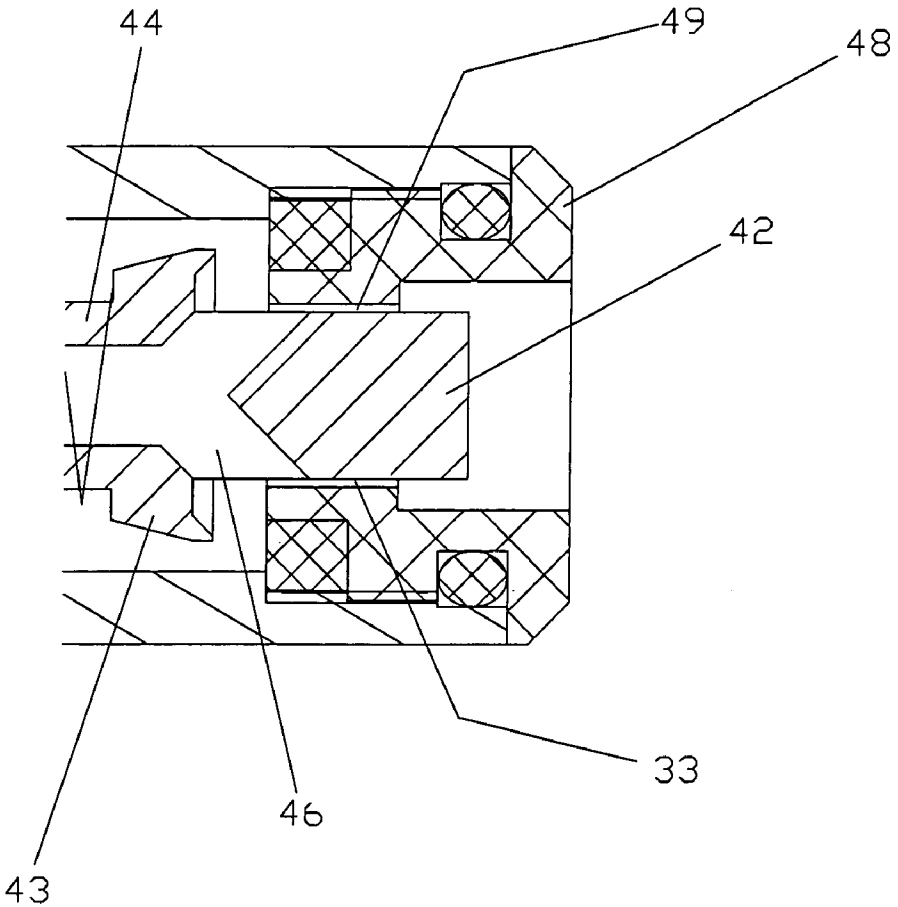
FIG. 11 is an enlarged partial cross sectional explanatory drawing of the air gun of the first embodiment of this invention.

Numeral 5 is a magazine. The magazine 5 is positioned at a gun rear end side lower section of the barrel 2, capable of being removed from the body of the air gun 1. Then, when fitting to the air gun 1, the upper part of the magazine is provided with an opening 5*b* in the same direction as the opening of the barrel 2. As shown in FIG. 11, an indent 5*a* defining substantially the same curved surface as the spherical surface of the bullet W is provided at an inner surface upper part of the opening of the magazine, so that it is easy to hold a fed bullet W. Also, a magazine follower 6 and magazine spring 7 normally urging a bullet W loaded in the magazine 5 towards the upper opening are provided in an inner part of the magazine 5. The magazine follower 6 has an upper section with a spherical surface the same as a bullet W, and a lower section engages with the magazine spring 7. By making the magazine follower spherical, downward movement becomes possible even if there are no bullets loaded in the magazine and it is empty, and there is no damage even if the magazine is empty.

Numeral 8 is a cylinder. The cylinder 8 is formed as a cylinder closed at a gun rear end side, and is fixed to an inner wall of the slide 3 so that a muzzle D side is open at a gun rear end side of the slide. Also, at a side surface lower section of the cylinder 8, compared to another side surface, there is a notch 80 cut out to a gun rear end side. Numeral 9 is a cylindrical hit pin, with a flange section 9*a* that is larger in diameter than the rest of the hit pin being provided on one end. The hit pin 9 is inserted from the muzzle side D into a through hole formed substantially in the center of a gun rear end side surface opposite an opening of the cylinder from the inner side of the cylinder 8, and projects to the gun rear end side, with the flange section 9*a* contacting the inner surface of the cylinder 8 and provided-capable of sliding. The hit pin 9 provided in this way is pressed by a hammer, that will be described later, and moves to the muzzle D side.

10 is a hammer. The hammer 10 is provided at a gun rear end side of the cylinder 8. A hammer shaft 11 is provided so as to be freely rotatable at to a lower portion of the hammer 10 at the same time as being fixed to the body of the air gun 1, with the hammer 10 being freely rotatable about the hammer shaft 11. A hammer strut shaft 12 capable of rotatable attachment of a hammer strut 19, which will be described later, is also provided on the hammer 10, at a gun rear end side of the hammer shaft 11. Also, a shear engagement section 13, being a projection capable of engaging with a shear 14 when an upper part of the hammer 10 has rotated to the gun rear end side, is provided on the hammer 10.

Numeral 14 is a shear. The shear 14 is provided close to a muzzle side of the hammer 10, with a lower end being attached to the body of the air gun 1 so as to be rotated by rotation of a rotation shaft 15, with the rotation shaft 15 as a center. The shear 14 has a hammer engagement section 16 capable of engagement with the shear engagement section 13 of the hammer 10 provided at a central part, so that a rotational state of the hammer 10 is maintained in a state where the upper part of the hammer 10 has rotated to the gun rear end side. An engagement projection 17 for engagement with a trigger bar 26, which will be described later, is provided on an upper end of the shear 14. Numeral 18 is a shear spring, arranged between the body of the air gun 1 and the shear 14, and normally urging the shear 14 to the hammer 10 side. As a result, the shear engagement section 13 of the hammer 10 and the hammer engagement section 16 of the shear 14 are maintained in an engaged state once they are engaged, and by rotating the shear 14 to the muzzle side against the urging force of the shear spring 18 using the trigger bar 26, which will be described later, engagement is released to rotate the hammer 10 to the muzzle side.

Figure 3:
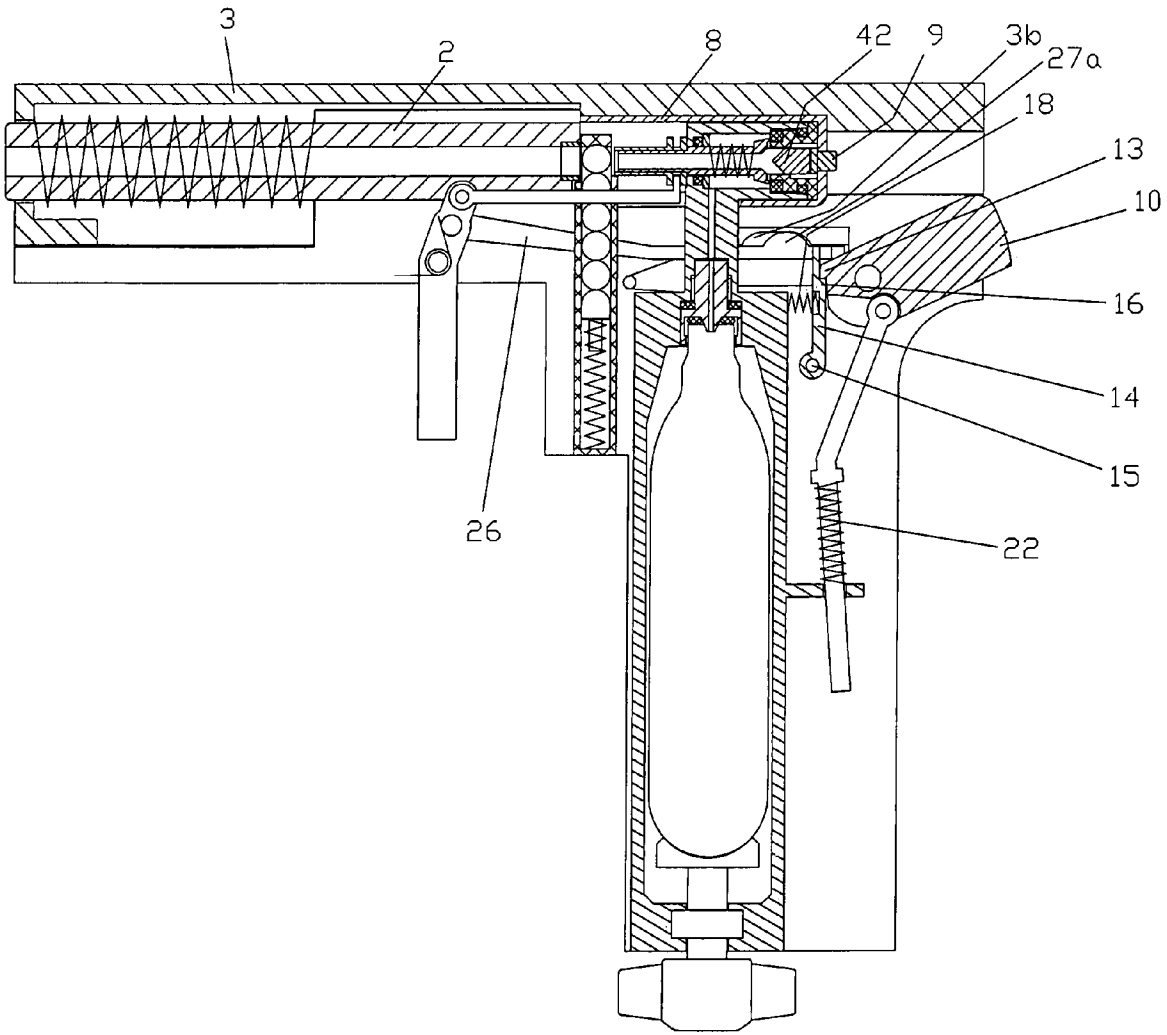
FIG. 3 is a cross sectional explanatory drawing of an operational state of the air gun of the first embodiment of this invention.

Numeral 19 is a hammer strut, with one rotatable end, attached to the hammer strut shaft 12 provided on a gun rear end of the hammer shaft 11, and the other end inserted into a through hole formed in a hammer strut fixing section 20 fixed to an inner part of the handle section 1*a*. A hammer spring 22 is then provided on the hammer strut 19 between the projection section 21 provided at an intermediate part of the hammer strut 19 and the hammer strut fixing section 20, urging the hammer 10 to the muzzle D side when it has been rotated to the gun rear end side. As a result, in the state shown in FIG. 1, the hammer 10 is positioned without being rotated, rotated to the gun rear end side as shown in FIG. 3, and in a state engaged with the shear 14 is urged to the muzzle D side. In this way by engaging the shear 14 with the hammer 10 that has been rotated to the gun rear end side, the hammer 10 stores force for rotating to the gun rear end side, and when engagement is released and the hammer 10 rotates to the muzzle D side the hammer 10 comes into contact with the hit pin 9 and the hit pin 9 becomes capable of sliding to the muzzle D side.

Numeral 23 is a trigger. The trigger 23 has a trigger shaft 24 provided at a middle part of the trigger 23 that rotates on a shaft, and is normally urged to the muzzle side by a trigger spring 25.

Numeral 32 is a bullet feed nozzle link. The bullet feed nozzle link 32 has a muzzle D side end engaging with a bullet feed nozzle link shaft 29 at an upper end of the trigger 23, and a gun rear end side is engaged with a bullet feed nozzle 36 that will be described later. A bullet feed nozzle engagement projection 51 engaging with a bullet feed nozzle link engagement projection 52 of the bullet feed nozzle 36 is provided on rear part of the bullet feed nozzle link 32. The bullet feed nozzle link 32 moves to the nozzle side as a result of a user pulling the trigger 23 to rotate the trigger 23 about the trigger shaft 24 against the urging of the trigger spring 25.

Numeral 26 is a trigger bar. The trigger bar 26 is arranged between the trigger shaft 24 and the bullet feed nozzle link shaft 29, and between the engagement projection 17 of the shear engagement section 13, and rotatably engages with the trigger 23 at an upper end of the trigger 23. If the trigger 23 is pulled by a user, to rotate the trigger 23 about the trigger shaft 24 against the urging force of the trigger spring 25, the trigger bar 26 is moved to the muzzle side. Also, a shear projection 27 is provided on a gun rear end side of the trigger bar 26, capable of moving the engagement projection 17 of the shear 14 to the muzzle side by moving the trigger bar 26 to the muzzle side. The shear projection 27 of the trigger bar 26 constructed in this way is provided so as to position the shear 14, which means that it is it is positioned at a lower part of the slide 3. At the shear projection 27 side of the trigger bar 26, at a position opposite to the engagement indent 3*b* provided at a lower part of the slide 3, an engagement projection 27*a* capable of engaging with the engagement indent 3*b* is formed. The engagement projection 27*a* is capable of engaging with the engagement indent 3*b*, by sliding the slide 3 to the gun rear end side engagement of the engagement projection 27*a* with the engagement indent 3*b* is released to move the engagement projection 27*a* downwards. However, the engagement indent 3*b* at the lower part of the slide 3 is provided having a width capable of moving within the engagement indent 3*b* even if the trigger bar 26 moves to the gun rear end side as a result of the trigger 23 being pulled in order to fire, and with movement of the trigger bar 26 to the gun rear end side, engagement between the engagement projection 27*a* and the engagement indent 3*b* is not released. By providing the trigger bar 26 between the trigger 23 and the shear 14 in this way, it becomes possible to rotate the shear 14 to the muzzle D side, and by rotating the shear 14 the hammer 10 engaged with the shear 14 is rotated to the muzzle D side. Also, if the slide 3 is slid to the gun rear end side to release engagement between the engagement projection 27*a* and the engagement indent 3*b* of the slide 3, the trigger bar 26 is moved downwards to release engagement between the shear projection 27 of the trigger bar 26 and the engagement projection 17 of the shear 14. In this way, if the trigger bar 26 is moved downwards as a result of sliding the slide 3 to the gun rear end side to release the engagement between the engagement projection 27*a* and the engagement indent 3*b*, the shear projection 27 of the trigger bar 26 will no longer be able to engage with the engagement projection 17 of the shear 14, which means that even if the trigger bar 26 is moved to the muzzle side as a result of pulling the trigger 23 in order to fire, since the shear 14 moves to the hammer 10 side, which is the initial position, due to the urging force of the shear spring 18, it is possible to once again cause engagement of the hammer 10 and the shear 14.

Numeral 28 is a valve body, and 48 is a valve body rear cover. The valve body 28 is cylindrical in shape, with a hollow valve chamber 30 provided at an inner part, and is positioned within the hollow part of the cylinder 8 and fixed to the body of the air gun capable of sliding inside the cylinder 8. As a result, if the slide 3 moves to the gun rear end side the valve body 28 fitted into the cylinder 8 also moves to the gun rear end side, which means that a space is formed inside the cylinder 8, if the slide is moved as far as possible to the muzzle D side direction the gun rear end side of the valve body 28 is moved further to the muzzle D side that the notch part 80 of the cylinder 8, and gas within the space inside the cylinder 8 formed by the valve body 28 can be discharged from the notch part 80 to the outside. With this embodiment, valve body 28 movement distance for the space of the valve body 28 and the gun rear end side inner surface of the cylinder 8 is about 31 mm in a state where the muzzle side lower part 3*c* of the slide 3 contacts the valve fixing section 2*a* and the slide 3 is moved as far as possible to the gun rear end side (state shown in FIG. 2 and FIG. 9), but compared to this movement distance for positioning the gun rear end side of the valve body 28 at the notch section 80 is about 1 mm. Also, through holes of smaller diameter than the valve pin chamber 30 are formed extending from the gun rear end side of the valve body 28 to the muzzle side. The respectively formed through holes are called a muzzle side through hole 31 that is formed at a muzzle side of the valve pin chamber 30 and a rear end side through hole 33 formed in a gun rear end side of the valve pin chamber 30. The muzzle side through hole 31 is formed enclosing a donut shaped ring packing 35 between a muzzle side wall of the valve body 28 and a packing press washer 34 provided at a valve pin chamber side of the muzzle side wall of the valve body 28. Also, the gun rear end side diameter of the rear end side through hole 33 is a larger diameter than the hit pin 9 of the cylinder 8, and when the valve body 28 is positioned as far as possible to the gun rear end side inside the cylinder 8 it is possible for the gun rear end side surface of the valve body 28 to contact a gun rear end side inner surface of the cylinder 8. Still further, a gas feeding port C, being a compressed gas path for feeding from the compressed gas cylinder A housed inside the handle section 1*a* to the valve body 28 is opened in a side surface lower section of the valve pin chamber 30.

The gas feeding port C has an upper end opened to the valve pin chamber 30, and a lower end positioned at an upper end of the compressed cylinder inserted in and fixed in the handle section 1*a*. There is a seal breaking pin (not shown) for breaking a seal section (not shown) provided on an upper part of the compressed gas cylinder A at a lower end of the gas feeding port C, the seal breaking pin breaks the seal of the compressed gas cylinder C by inserting and fitting the compressed gas cylinder into the handle section 1*a*, compressed gas passes through the gas feeding port C to be fed to the valve pin chamber 30, and it becomes possible to normally increase gas pressure in the compressed gas to the valve pin chamber 30.

Numeral 36 is a bullet feeding nozzle. The bullet feeding nozzle 36 is formed in a cylindrical shape, with a rib shaped bullet feeding nozzle link engagement projection 52 capable of engaging with a bullet feeding nozzle engagement projection 51 being provided at a gun rear end side. The bullet feeding nozzle 36 is arranged at a muzzle D side of the valve body 28, a gun rear end side section is fitted into a bullet feeding nozzle insertion section 41 projecting at a muzzle side of the valve body 28, a muzzle side end section is positioned towards a gun rear end side of an upper opening of magazine 5 positioned at a gun rear end side of the barrel 2. The bullet feeding nozzle 36 provided in this way has a muzzle D side tip part of the bullet feeding nozzle 36 press a bullet W inside an opening 5*b* of the magazine positioned at a muzzle D side of the valve body 28 by moving in the muzzle D direction, and move the bullet W into a chamber 37 provided at a gun rear end section of the barrel 2.

Numeral 39 is a valve pin. The valve pin 39 is cylindrical in shape, and is comprised of a gun rear side pin body 40, and a muzzle side bullet feed nozzle insertion section 41.

A pressing section 42 is provided on a gun rear end side of the pin body 40. The pin body 40 has a muzzle D side tip fitted into a muzzle side through hole 31, and sliding is possible while maintaining an air-tight seal between an outer periphery of the pin body 40 and a ring packing 35. The bullet feed nozzle insertion section 41 connected to the pin body 40 projects to the muzzle side of the valve body 28. Also, the pin body 40 is arranged so that the connected pressing section 42 is inserted into the rear end side through hole 33 to position a gun rear end side tip part of the pressing section 42 adjacent to the hit pin 9. It is then possible for the pressing section 42 to slide in a state where compressed gas cam pass between the pressing section 42 and the rear end side through hole 33. A valve pin flange section 43 contacting the gun rear end side side surface of the valve pin chamber 30 is provided at a gun rear end side of the pin body 40, having a smaller diameter than the inner diameter of the valve pin chamber 30. The valve pin flange section 43 and the gun rear end side side surface of the valve pin chamber 30 are then brought into contact to give an airtight state. With this embodiment, a flat packing 47 formed in a ring shape is arranged at a gun rear end side side surface of the valve pin chamber 30 that contacts the valve pin flange section 43. Numeral 44 is a valve pin return spring, and the valve pin return spring 44 is a coil spring, with the pin body 40 inserted into it, provided between the valve pin flange section 43 of the pin body 40 and the muzzle side through hole 31, and normally urging the pin body 40 to the gun rear end side. The gun rear end side side surface of the valve pin chamber 30 and the valve pin flange section 43 are caused to maintain a sealed state by the urging force of the valve pin return spring 44. Also, a passage 45 opening to the muzzle side is provided in a cylindrical section of the pin body 40 provided as described above, and a valve pin chamber opening 46 opening to the side surface of the pin body 40 is provided at a muzzle side of the pressing section 42, enabling through flow of compressed gas.

By providing the valve pin 39 in the valve pin chamber 30 of the valve body 28 in this way, if the valve pin 39 is pressed against the hammer 10, pressed against the hit pin 9 that has moved to the muzzle D side, and moved to the muzzle D side, a clearance is formed between the valve pin flange section 43 of the pin body 40 and the gun rear end side side surface of the valve pin chamber 30, compressed gas normally supplied to the valve pin chamber 30 passes from the clearance formed by the gun rear end side side surface of the valve pin chamber 30 and the valve pin flange section 43 through the valve pin side opening 46 of the pin body 40 and the passage 45, is supplied to the muzzle D side opening of the bullet feeding nozzle 36 and fires the bullet W inside the chamber 37.

Next, a second embodiment relating to claim 2 of the invention will be described below, but only those parts of the structure that are different from the structure of the first embodiment described above are described.

A cylinder section 8*a* of this second embodiment of the invention is cylindrical in shape closed at a gun rear end side, provided so as to be capable of movement at an inner wall of a slide 3 so as to open the muzzle D side at a gun rear end side of the slide 3, and differs from the first embodiment in that there is no hit pin 9.

A pressing section 42*a* of the second embodiment is provided at a gun rear end side of the pin body 40, fixed to the pin body 40, inserted into the rear end side through hole 33 of the valve pin 39 to project to the gun rear side, and has a gun rear side tip end positioned capable of contacting a muzzle side inner surface of a rear wall of the cylinder section 8*a*. The pressing section 42*a* is capable of sliding in a state where compressed gas can pass from a clearance between the outer peripheral surface of the pressing section 42*a* and the rear end side through hole 33.

When the cylinder section 8*a* is pressed to the muzzle D side by the hammer 10 and slides to the muzzle D side, the pressing section 42*a* is pressed against a muzzle side inner surface of a rear wall of the cylinder section 8*a*, the valve pin 39 slides to the muzzle D side against the urging force, and an airtight state between the valve pin flange section 43 and a gun rear end side side surface of the valve pin chamber 30 is released.

As a result, compressed gas supplied from the gas supply port C to the valve pin chamber 30 is supplied from between the gun rear end side side surface of the valve pin chamber 30 and the valve pin flange section 43 to the valve pin chamber side opening 46, through the bullet feed nozzle insertion section 41 and is supplied to the muzzle D side of the bullet feeding nozzle 36 to fire a bullet W from the muzzle. At the same time, compressed gas is supplied from a clearance between the pressing section 42*a* and the rear end side through hole 33 into which the pressing section 42*a* is inserted to the gun rear end side, causing the cylinder section 8*a* to move to the gun rear end side.

Next, operation of the first embodiment configured as described above will be described based on FIG. 1 to FIG. 11, and operation of the second embodiment configured as described above will be described based on FIG. 12 to FIG. 21.

The states shown in FIG. 1 and FIG. 12 are the basic position before operation of the air gun 1. In the basic position, the air gun 1 has the hammer rotated to the gun rear end side, in a state where the hit pin is not being pressed, and also, the compressed gas cylinder A is already housed inside the handle section 1*a*, and has a seal broken by the gas supply port C, with compressed gas then being supplied from the compressed gas cylinder A through the gas supply port C to inside the valve pin chamber 30 of the valve body 28. Also, bullets W are already loaded in the magazine 5, urged upwards by the magazine spring 7 and the magazine follower 6, with the first bullet W being positioned in an indent 5*a* of the opening 5*b*.

The inside of the valve pin chamber 30 of the valve body 28 is already full of compressed gas, and gas pressure of the compressed gas acts uniformly on the inner wall of the valve pin chamber 30 and an outer surface of the pin body 40 exposed to the inside of the valve pin chamber 30, but the force of compressed gas acting on the pin body 40 does not drive the valve pin 39 in a direction to move to the muzzle D side, and the valve pin 39 is urged to the gun rear end side by the valve pin return spring 44 so that valve pin flange section 43 contacts the gun rear end side inner surface of the valve pin chamber 30 in an air tight manner, which means that the valve pin 39 maintains an airtight state of contact between the valve pin flange section 43 and the gun rear end side inner surface of the valve pin chamber 30, and compressed gas does not move from the valve pin chamber 30 to the outside.

Figure 2:
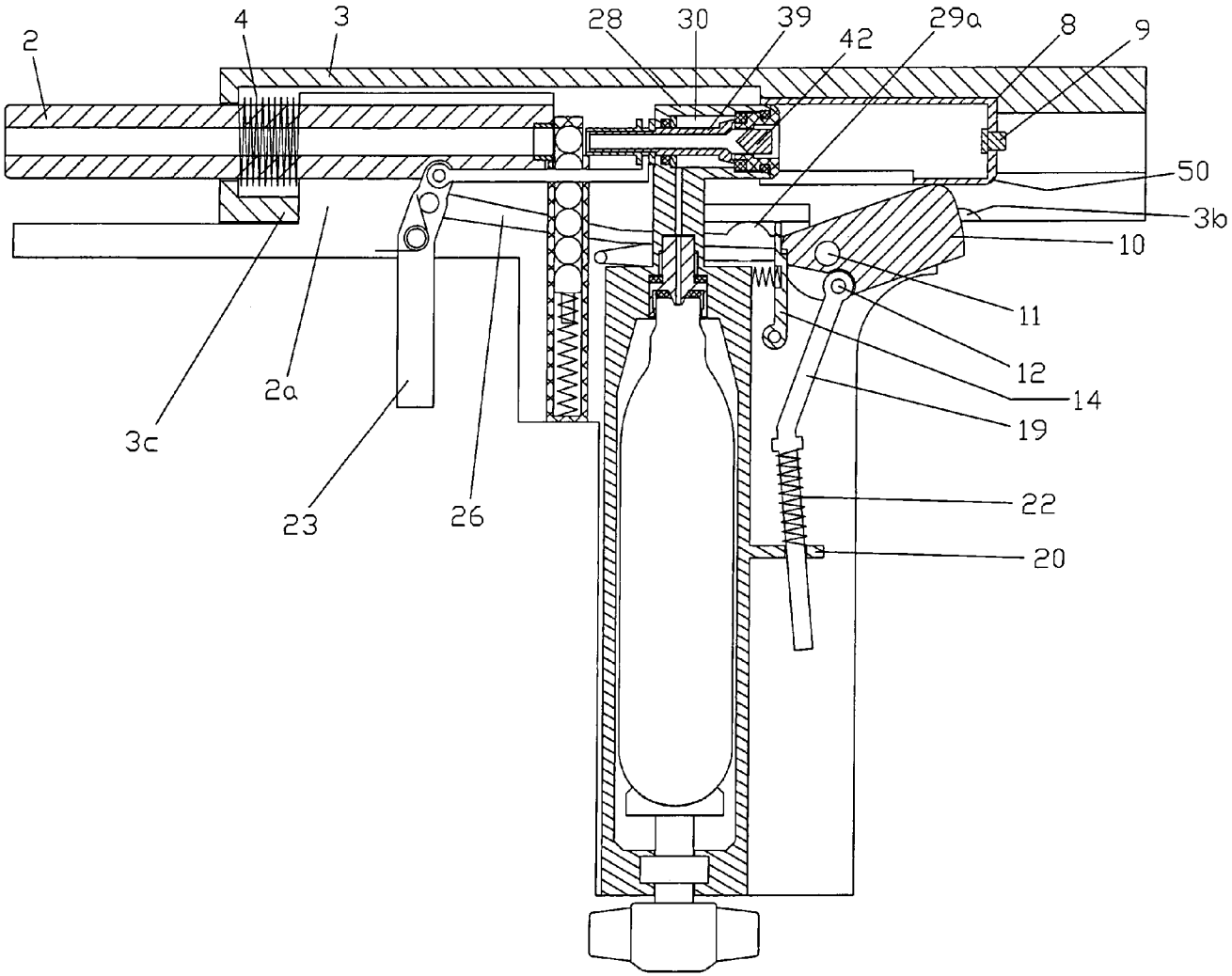
FIG. 2 is a cross sectional explanatory drawing of an operational state of the air gun of the first embodiment of this invention.

When using the air gun 1, as shown in FIG. 2 and FIG. 13, the slide 3 is moved to the gun rear end side against the urging force of the slide spring 4. In doing so, the cylinder 8, 8*a* inside the slide 3 are also moved to the gun rear end side. At this time, the hit pin 9 also moves together with the slide 3 to the gun rear end side, but the valve body 28 does not move. Also, since the valve pin 39 also does not move, compressed gas remains inside the valve pin chamber. If the cylinder 8, 8*a* is moved to the gun rear end side, the cylinder 8, 8*a* presses the hammer 10 by the extent of that movement at the rear lower end 50 of the cylinder 8, 8*a*, and the hammer 10 is rotated to the gun rear end side against urging force due to the hammer strut 19 and the hammer spring 22. At this time, the engagement projection 27*a* comes away from the engagement indent 3*b* of the slide 3, is moved downwards by a lower surface of the slide 3 and engagement with the shear 14 is released, which means that regardless of whether the trigger 23 is pulled or not pulled, the shear 14 is positioned at the same initial position at the hammer 10 side as in FIG. 1 and FIG. 12. If the slide 3 is subsequently moved as far as possible to the gun rear end, the muzzle side lower section 3*c* of the slide 3 comes into contact with the muzzle side lower part of the barrel fixing section and can no longer move to the gun rear end side, movement of the slide 3 is completed, and the slide 3 is returned to the same position as FIG. 1 and FIG. 12.

Figure 14:
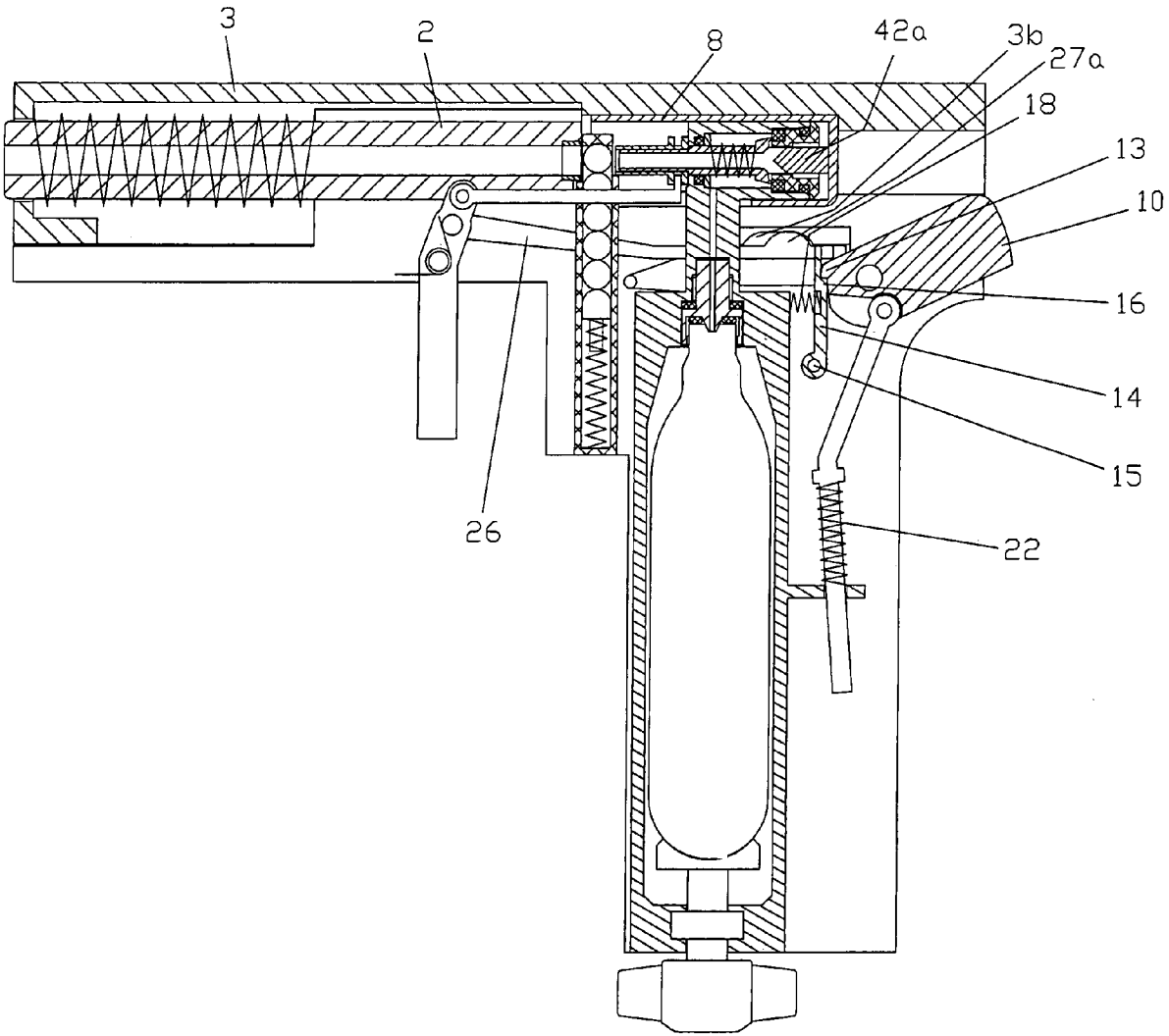
FIG. 14 is a cross sectional explanatory drawing of an operational state of the air gun of the second embodiment of this invention.

FIG. 3 and FIG. 14 show the state where the slide 3 has been returned. The hammer 10 has the shear engagement section 13 engaged with hammer engagement section 16 of the shear 14, and is fastened in a state rotated to the gun rear end side against urging force die to the hammer spring 22. The cylinder 8, 8*a* is also returned to the initial position shown in FIG. 1 and FIG. 12. Since the cylinder 8, 8*a* is returned to the initial position, the trigger bar 26 also moves upwards with the engagement projection 27*a* engaged with the engagement indent 3*b* of the slide 3.

Figure 4:
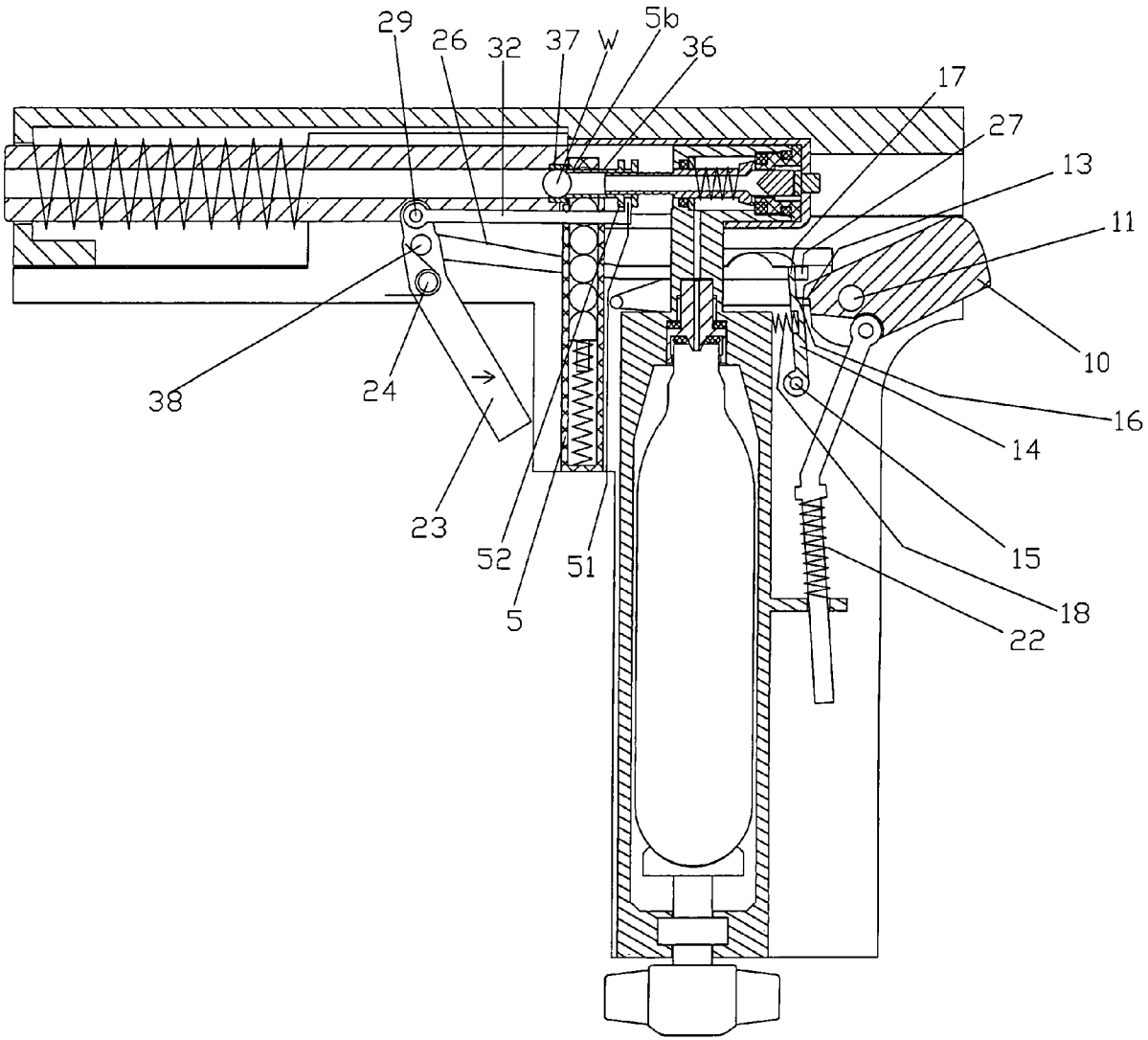
FIG. 4 is a cross sectional explanatory drawing of an operational state of the air gun of the first embodiment of this invention.
Figure 15:
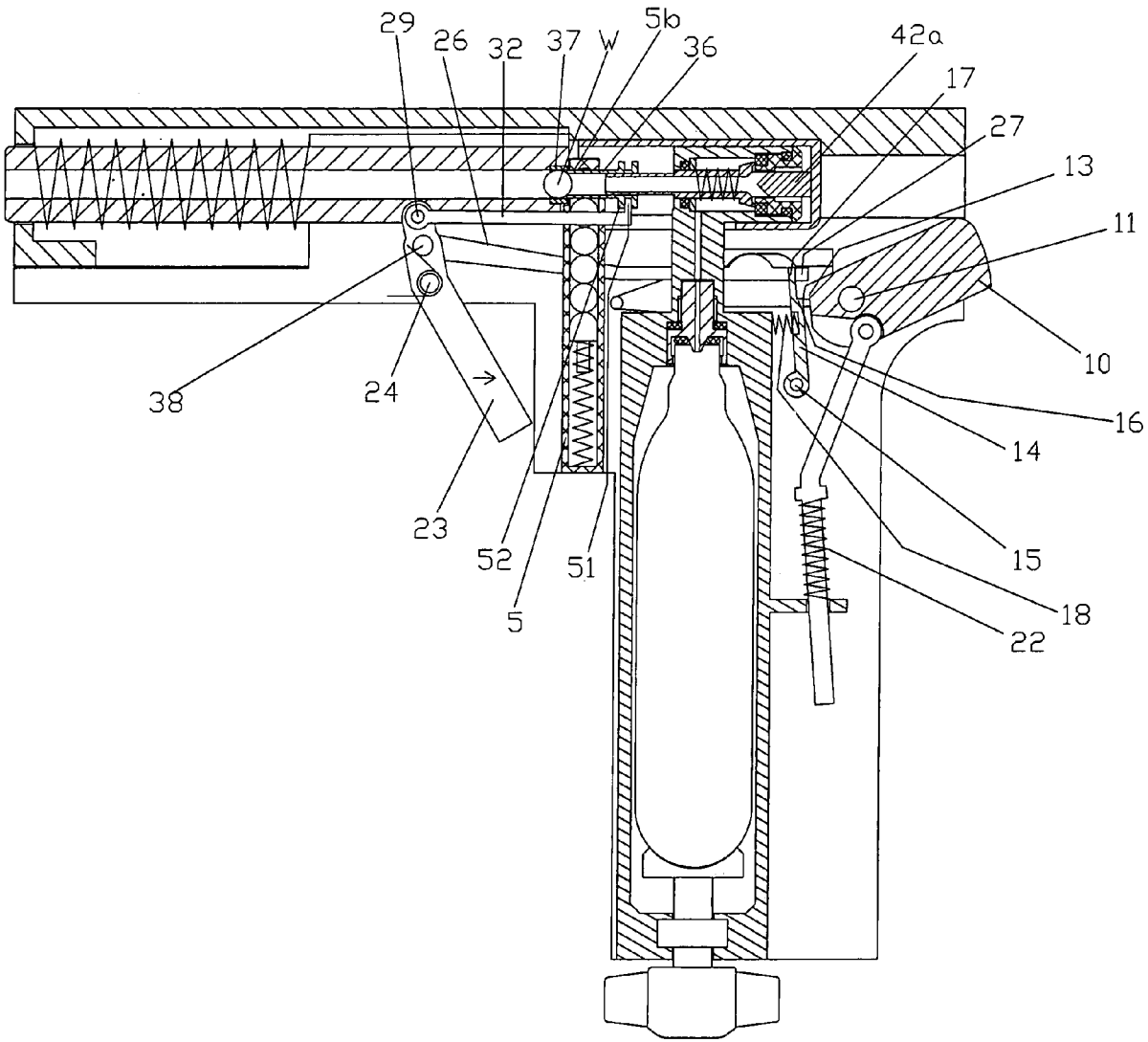
FIG. 15 is a cross sectional explanatory drawing of an operational state of the air gun of the second embodiment of this invention.

Next, as shown in FIG. 4 and FIG. 15, the user moves the trigger 23 to the gun rear end side as shown by the arrows in order to fire. In accompaniment with rotation of the trigger 23 to the rear, the trigger bar 26 and the bullet feed nozzle link 32 move to the muzzle D direction. As a result of movement of the bullet feed nozzle link 32, the bullet feed nozzle 36 moves to the muzzle D side by the bullet feed nozzle link engagement projection 52 for engaging with the bullet feed nozzle engagement projection 51, the bullet W at the uppermost position inside the magazine 5 is pushed out from the opening 5*b* bbband loaded inside the chamber 37. Since the bullet feed nozzle 36 is above, the next bullet W inside the magazine 5 can not rise up to the loadable position.

Figure 5:
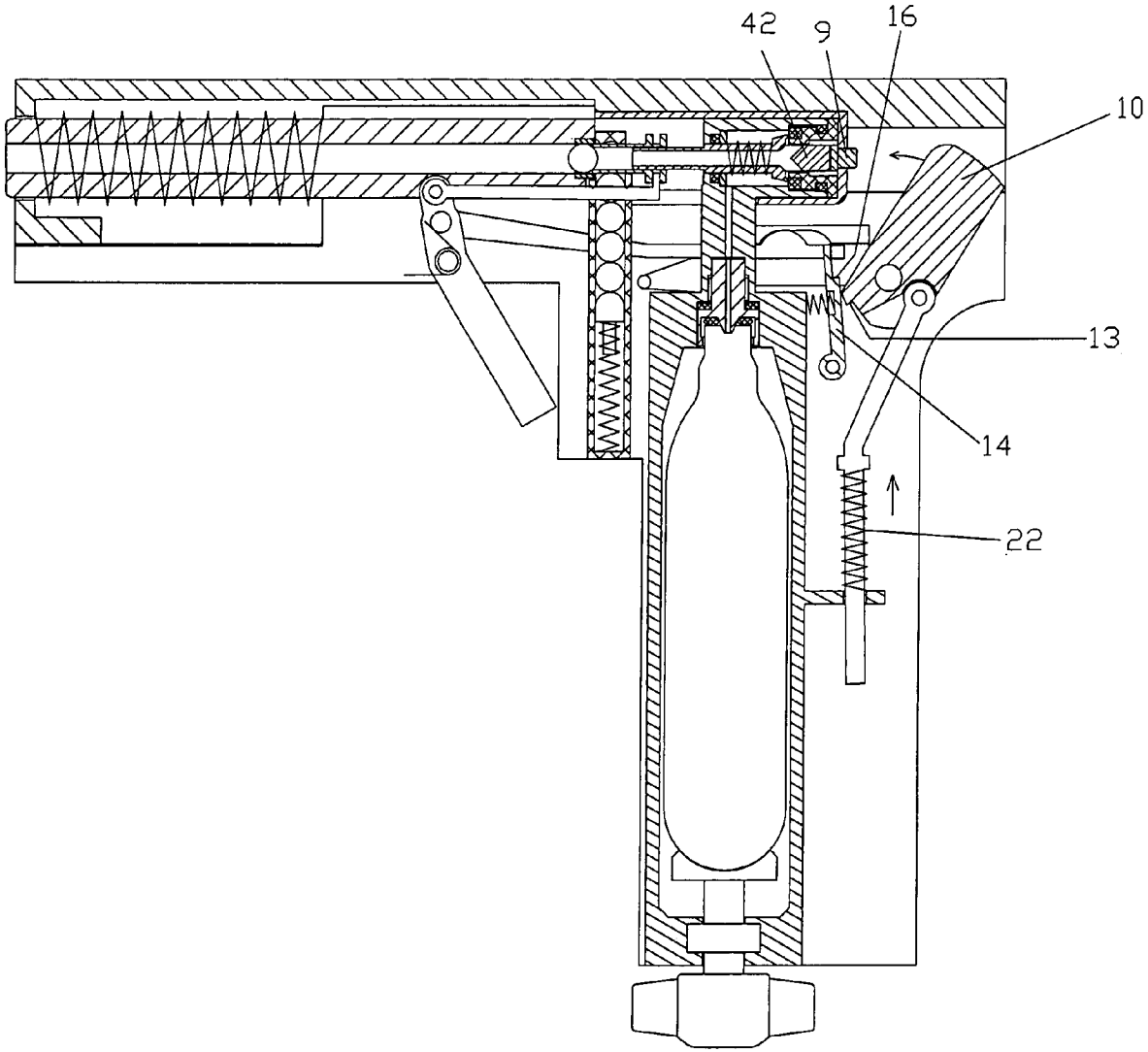
FIG. 5 is a cross sectional explanatory drawing of an operational state of the air gun of the first embodiment of this invention.
Figure 16:
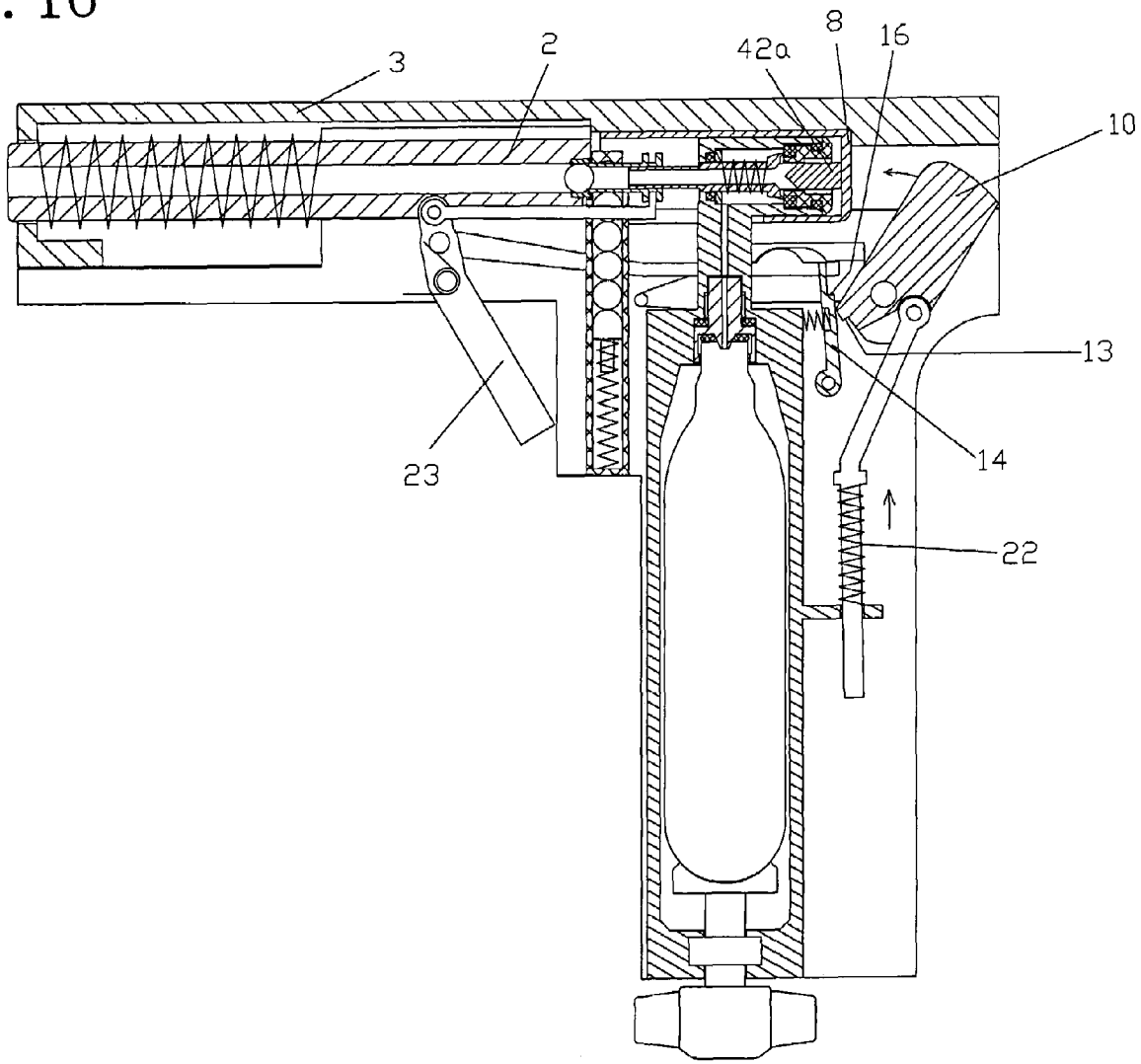
FIG. 16 is a cross sectional explanatory drawing of an operational state of the air gun of the second embodiment of this invention.

Also, as a result of movement of the trigger bar 26 to the muzzle D side, in the state of FIG. 4 and FIG. 15 there is engagement between the shear engagement section 27 of the trigger bar 26 and the engagement projection 17 of the shear 14, which means that the shear engagement section 27 of the trigger bar 26 causes the engagement projection 17 of the shear 14 to rotate in the muzzle D direction, and the shear 14 rotates to the muzzle D side against the urging force of the shear spring 18. Because the shear 14 has been rotated, as shown in FIG. 5 and FIG. 16, engagement between the hammer engagement section 16 of the shear 14 and the shear engagement section 13 of the hammer 10 is released, and the hammer 10 is rotated to the muzzle D direction by the urging force.

Figure 6:
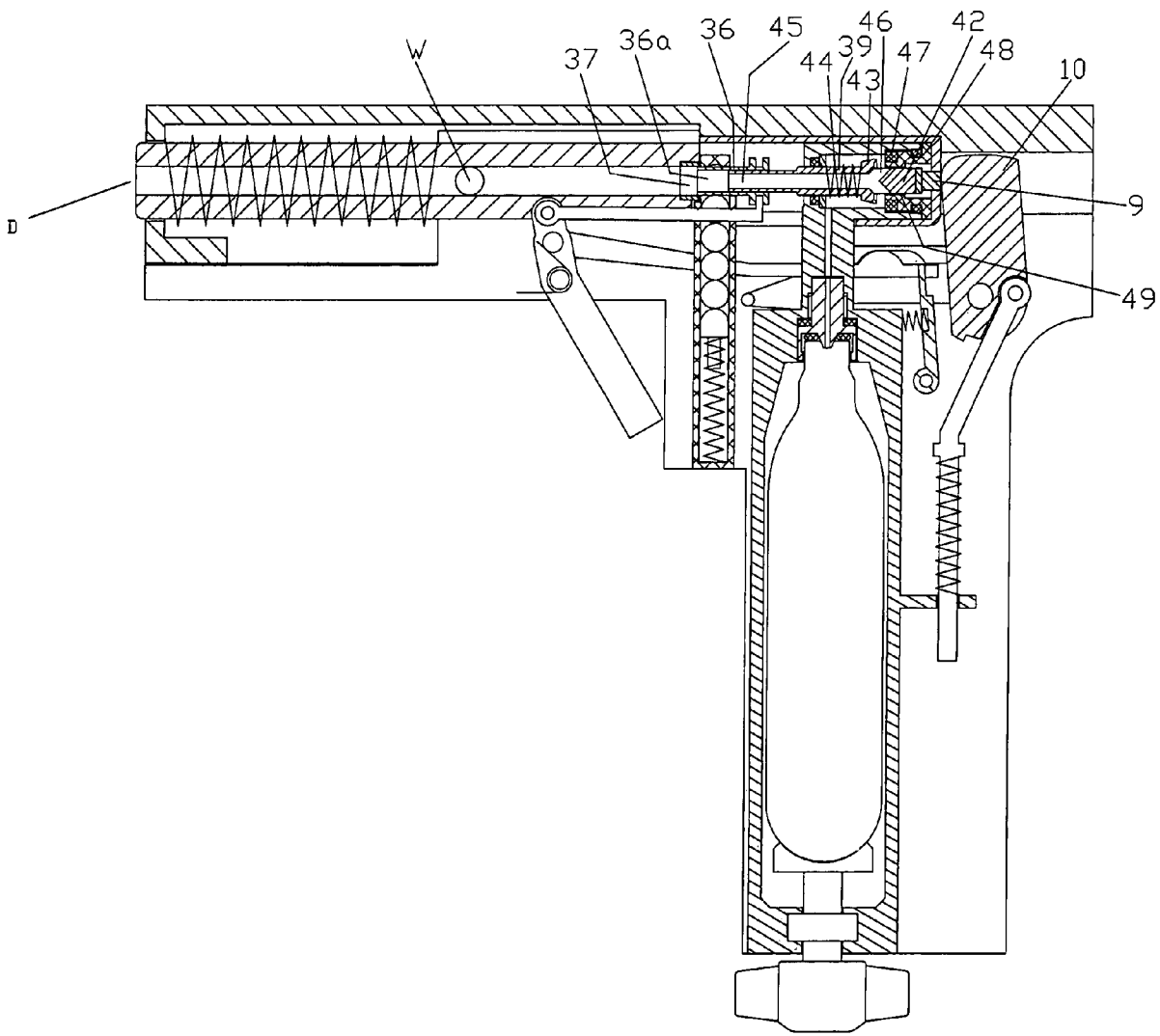
FIG. 6 is a cross sectional explanatory drawing of an operational state of the air gun of the first embodiment of this invention.
Figure 17:
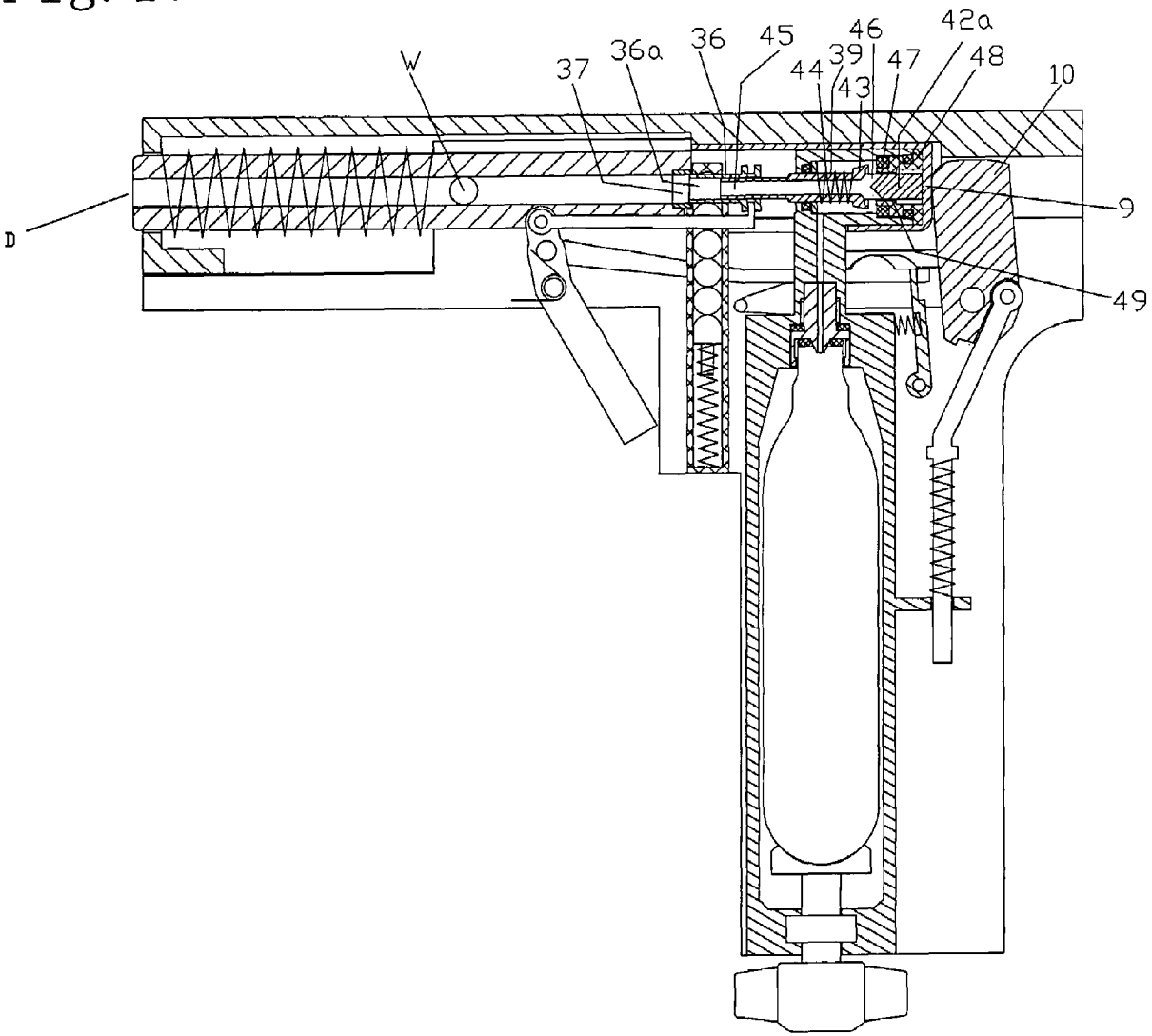
FIG. 17 is a cross sectional explanatory drawing of an operational state of the air gun of the second embodiment of this invention.

With the first embodiment, as shown in FIG. 6, the hammer 10 presses the hit pin 9. With the second embodiment, as shown in FIG. 17, the hammer 10 presses the rear section rear surface of the cylinder 8*a*. As a result of the hit pin 9 or the cylinder 8*a* being pressed to move to the muzzle D side, the valve pin positioned at the muzzle D side of the hit pin 9 or the cylinder 8*a* is pressed against the rear inner surface of the hit pin 9 or the cylinder 8*a* and moved to the muzzle D side against the urging force of the valve pin return spring 44.

If the valve pin 39 is moved to the muzzle D side, the valve pin flange section 43 of the valve pin 39 is also moved to the muzzle D side, contact of the airtight state between the gun rear end side inner wall of the valve pin chamber 30 and the valve pin flange section 43 is released, compressed air that has been supplied to the valve pin chamber 30 passes through a clearance made possible between the gun rear end side inner wall of the valve pin chamber 30 and the valve pin flange section 43, and supplied into a pin body 40 from a valve pin chamber side provided on the pin body 40 of the valve pin 39. Compressed gas supplied to the inside of the pin body 40 passes through the passage 45, and also through the through hole 36*a* of the bullet feed nozzle 36, to fire the bullet W loaded inside the chamber 37. At the same time, with the first embodiment, compressed gas flows out from a clearance 49 between the pressing section 42 continuously fixed to the gun rear end side of the pin body 40 and the rear end side through hole 33 of the valve body 28 to the hit pin 9 side.

Also, with the second embodiment, at the same time from a clearance 49 between the pressing section 42 continuously fixed to the gun rear end side of the pin body 40 and the rear end side through hole 33 of the valve body 28 to the rear inner surface side of the cylinder 8*a*.

Figure 7:
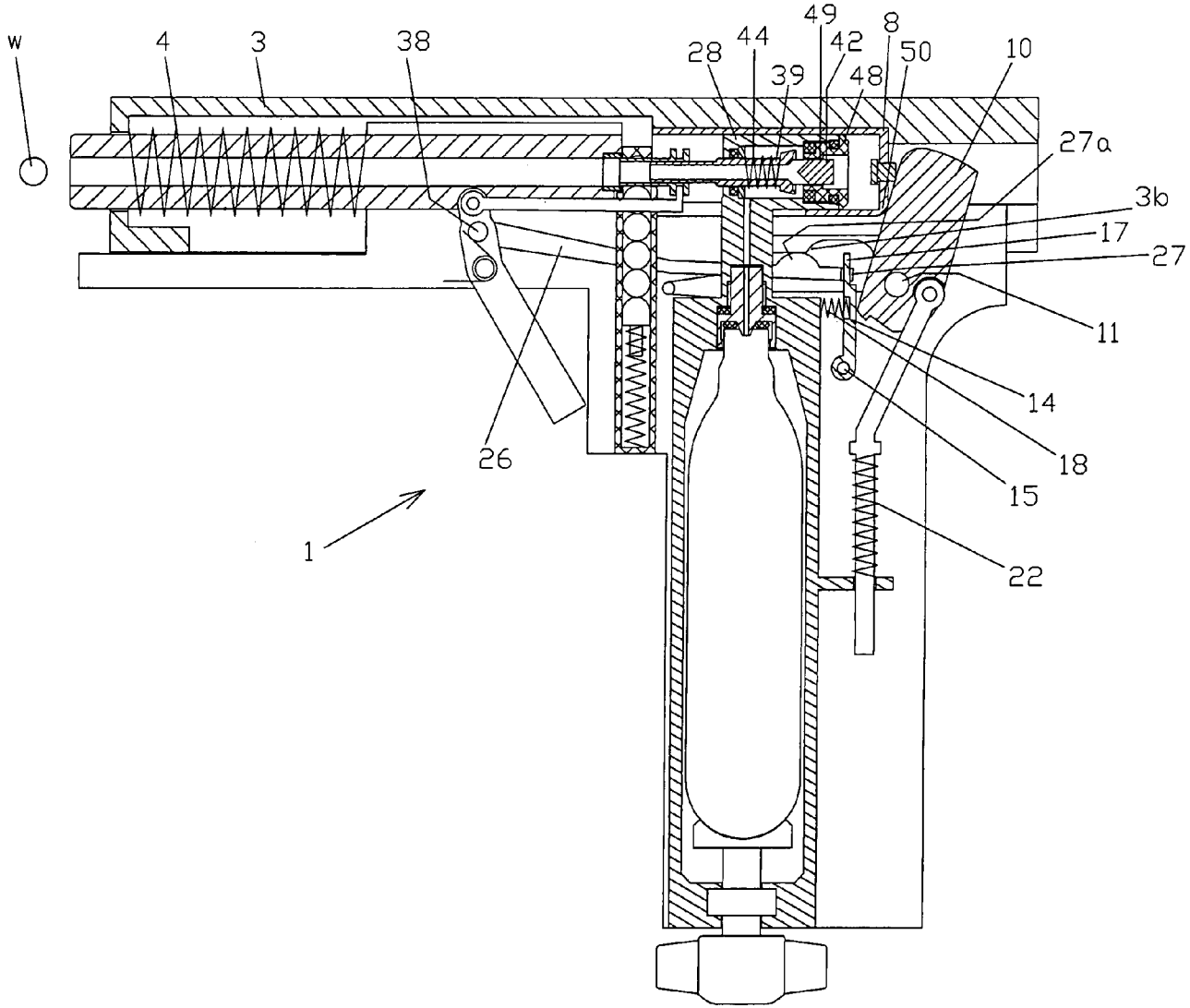
FIG. 7 is a cross sectional explanatory drawing of an operational state of the air gun of the first embodiment of this invention.
Figure 18:
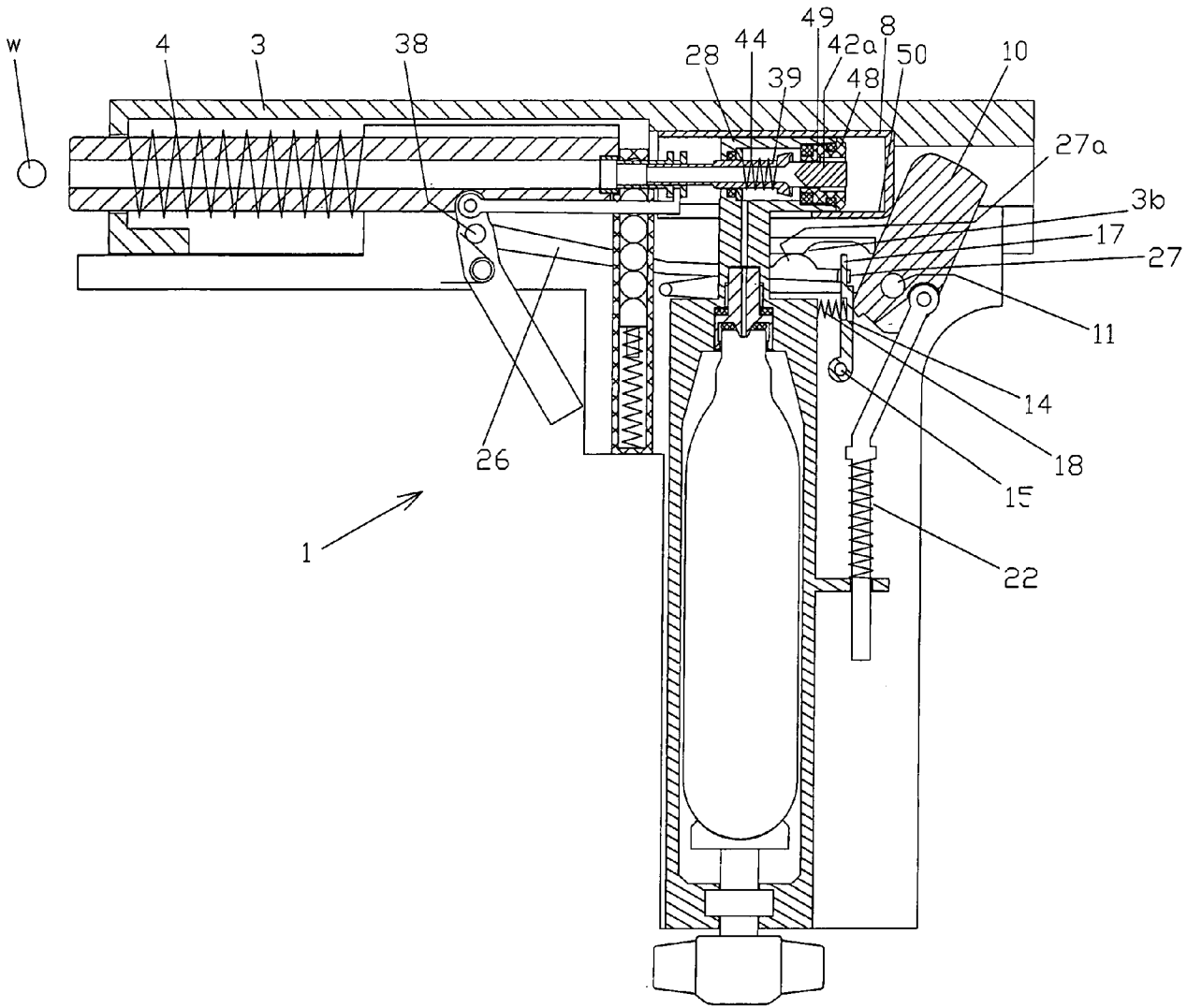
FIG. 18 is a cross sectional explanatory drawing of an operational state of the air gun of the second embodiment of this invention.

FIG. 11 is an enlarged explanatory drawing of the area around the pressing section 42. Inflow of compressed gas continues further, the gun rear end side inner surfaces of the cylinder 8, 8*a* are pressed by gas pressure of compressed gas flowing out from the clearance 49 between the pressing section 42, 42*a* and the rear end side through hole 33 to the gun rear end side, a space is formed at the gun rear end side inside the cylinder 8, 8*a* between the gun rear end side of the valve body 28, and the formed space can be expanded by gas pressure of compressed gas flowing in. This state is shown in FIG. 7 and FIG. 18. At this time, since the valve body 28 is inside the body of the air gun 1, the cylinder 8, 8*a* is moved to the gun rear end side, and the slide 3 to which the cylinder 8 is fixed is also moved to the gun rear end side. In the state shown in FIG. 7 and FIG. 18, the rear lower end side 50 of the cylinder 8, 8*a* has already started to move the hammer 10 to the gun rear end side. Also, since the slide 3 slides to the gun rear end side, the engagement projection 27*a* of the trigger bar 26 is released from engagement with the engagement indent of the lower section of the slide 3 to contact the lower end of the slide 3 to move downwards, and engagement between the trigger bar 26 and the shear 14 is released. Also, with the first embodiment, since the cylinder 8 has moved to the gun rear end direction, the hit pin 9 releases pressing pressure of the pressing section 42 of the valve pin 39, while with the second embodiment, since the cylinder 8*a* has moved to the gun rear end direction the cylinder 8*a* releases pressing pressure of the pressing section 42*a* of the valve pin 39, the valve pin 39 is subsequently pressed back to the gun rear end side by the urging force of the valve pin return spring 44.

Figure 8:
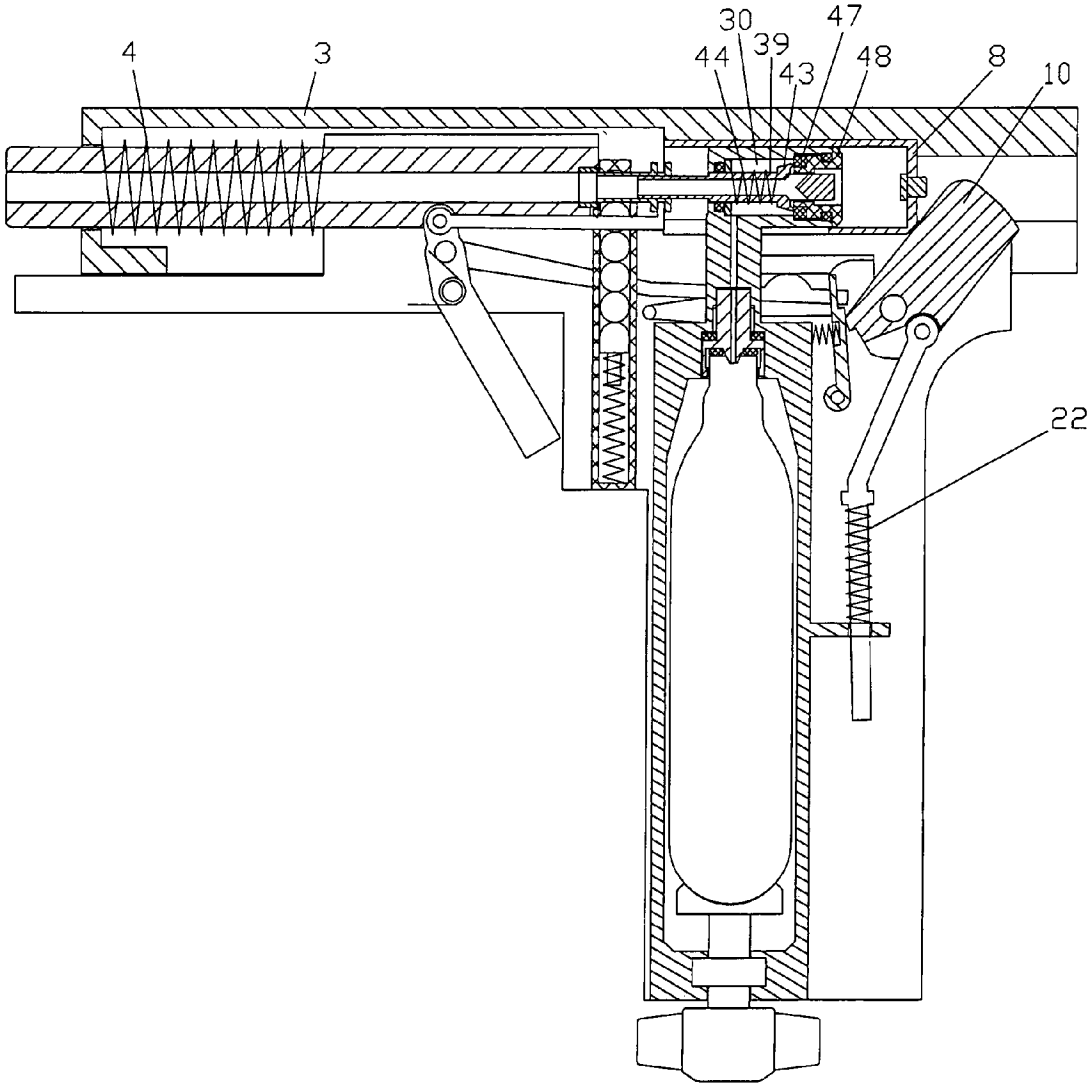
FIG. 8 is a cross sectional explanatory drawing of an operational state of the air gun of the first embodiment of this invention.
Figure 19:
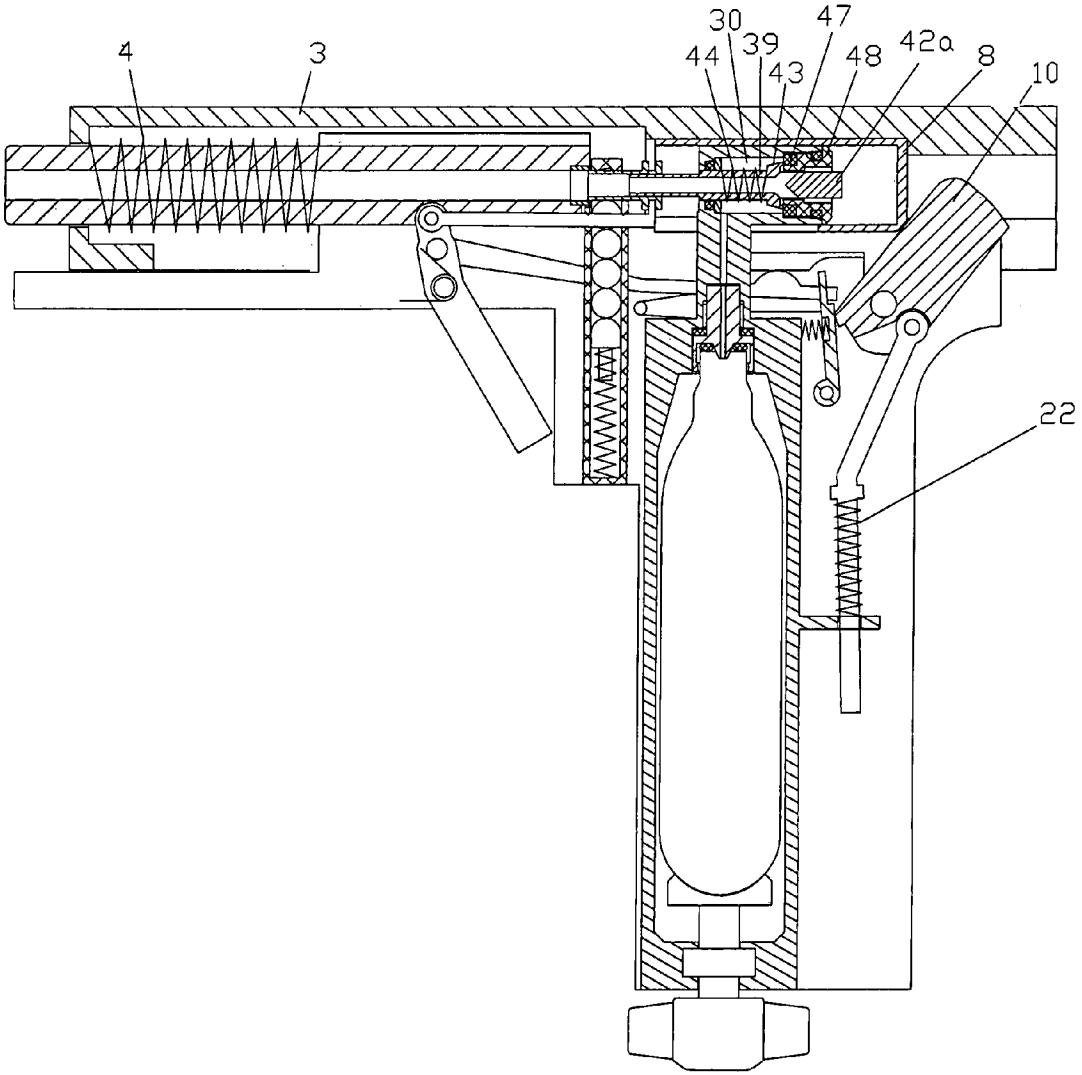
FIG. 19 is a cross sectional explanatory drawing of an operational state of the air gun of the second embodiment of this invention.

The state where the valve pin 39 has been returned to the gun rear end side is shown in FIG. 8 and FIG. 19. The valve pin flange section 43 of the valve pin 39 and the gun rear end side inner surface of the valve pin chamber 30 are in an airtight state, and supply of compressed gas to the inside of the valve pin 39 is completed. Even if supply is cut off, since compressed gas already supplied to the inside of the space of the gun rear end side inside the cylinder 8 continues expansion, the cylinder 8, 8*a* and the slider 3 continue to move further to the gun rear end side as a result of this expansion force and the inertia of the cylinder 8, 8*a* and the slide 3. If the slide 3 subsequently move as far as possible to the gun rear end side and the hammer rotates to the gun rear end side, the hammer 10 again engages with the shear 14. This state is shown in FIG. 9 and FIG. 20.

Figure 9:
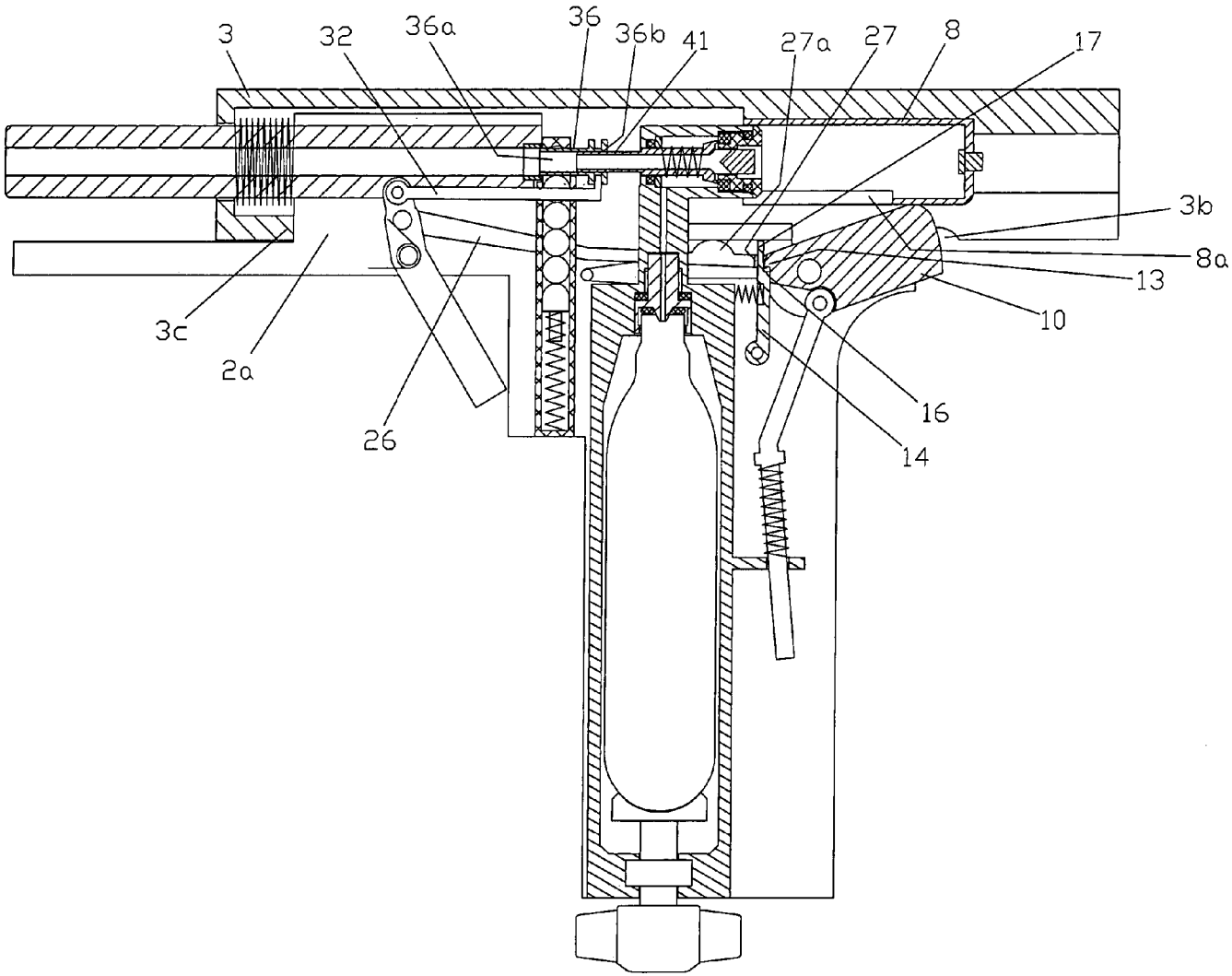
FIG. 9 is a cross sectional explanatory drawing of an operational state of the air gun of the first embodiment of this invention.
Figure 20:
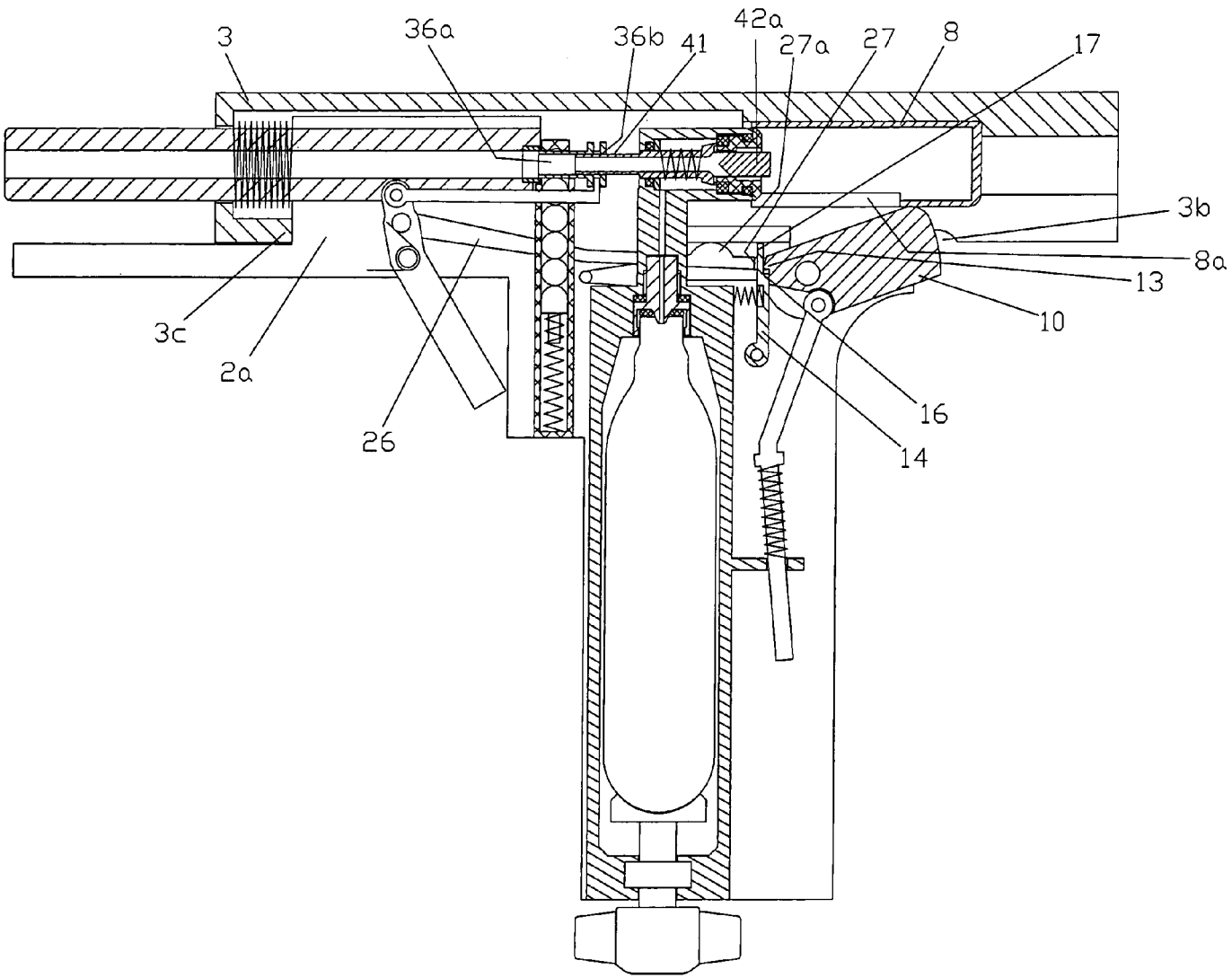
FIG. 20 is a cross sectional explanatory drawing of an operational state of the air gun of the second embodiment of this invention.

In the state shown in FIG. 9 and FIG. 20, the cylinder 8, 8*a* and the slide 3 are also moved as far as possible to the gun rear end side due to contact of the muzzle side lower section 3*c* with the barrel fixing section 2*a*, and gas is discharged from a clearance formed between a gun rear end side lower part of the valve body 28 and a notch 80 of the cylinder 8.

Engagement between the engagement projection 27*a* and the engagement indent 3*b* of the slide 3 is released and the trigger bar 26 comes into contact with the lower part of the slide 3, causing downward movement, and the engagement projection 17 of the shear and the shear engagement projection 27 of the trigger bar 26 are not engaged. The shear engagement section 13 of the hammer 10 and the hammer engagement section 17 of the shear 14 are once again positioned at the engagable position.

Figure 21:
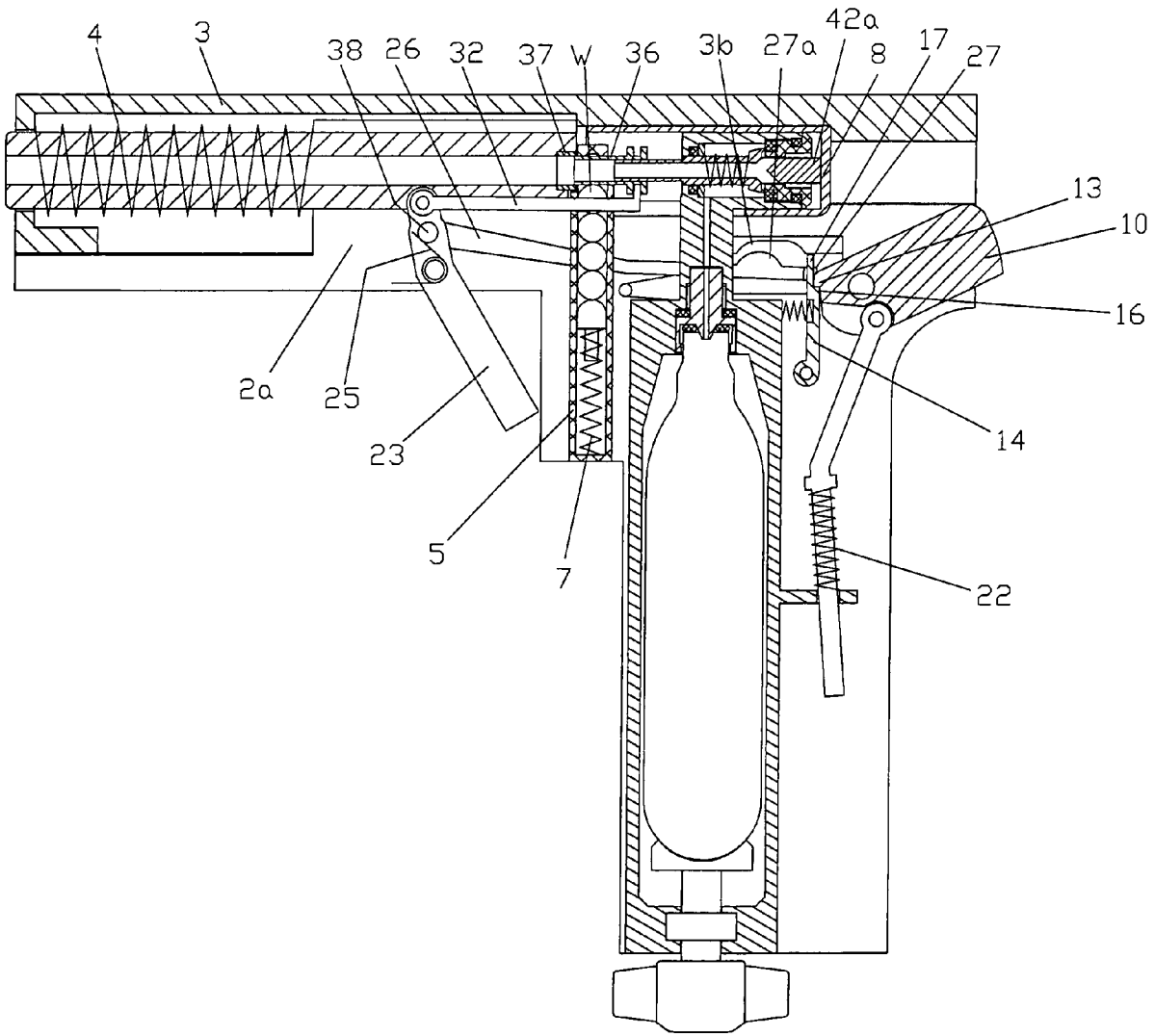
FIG. 21 is a cross sectional explanatory drawing of an operational state of the air gun of the second embodiment of this invention.
Figure 22:
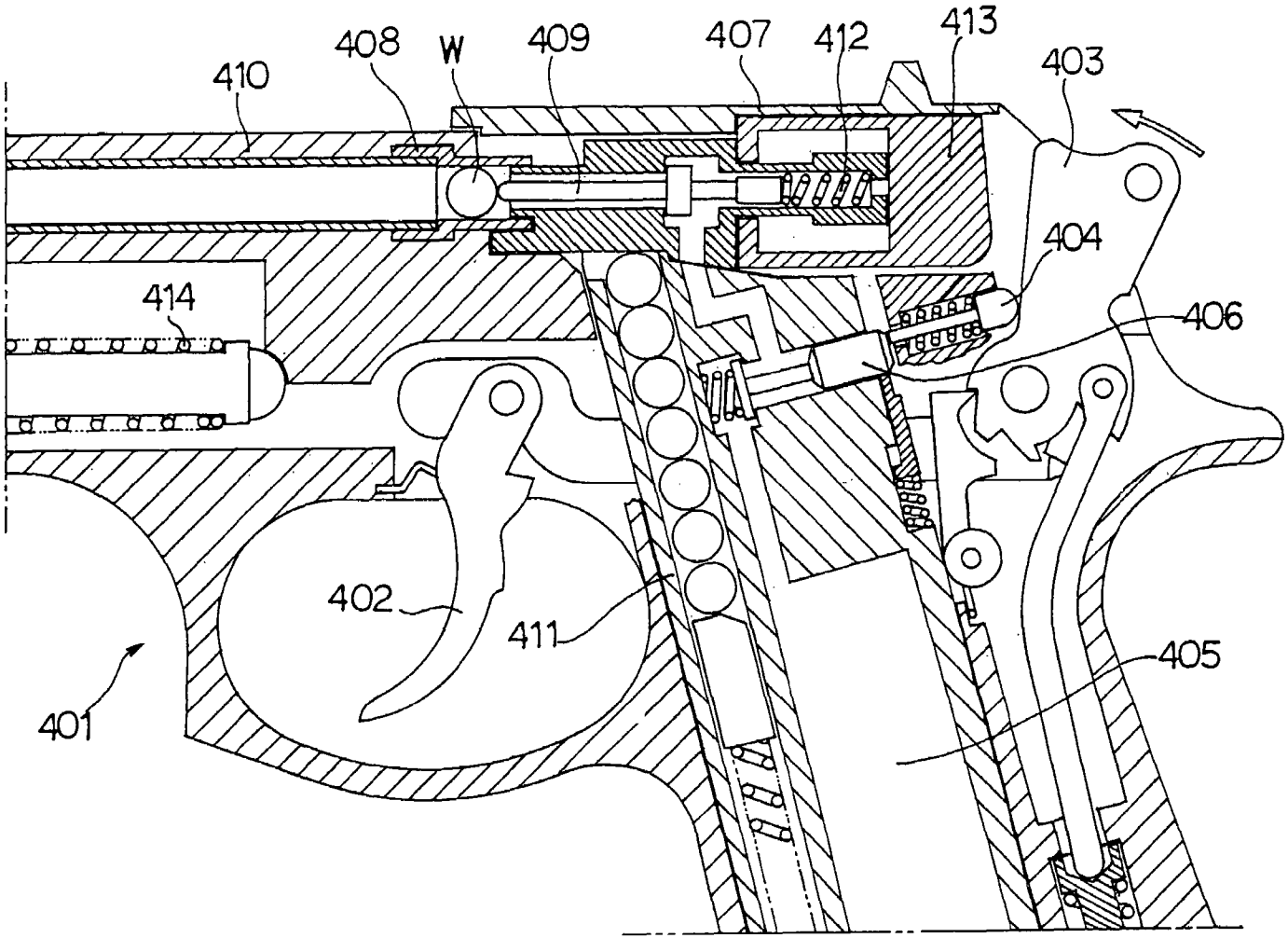
Related Art Fig.22
FIG. 22 is an explanatory drawing of related art 1.
Figure 23:
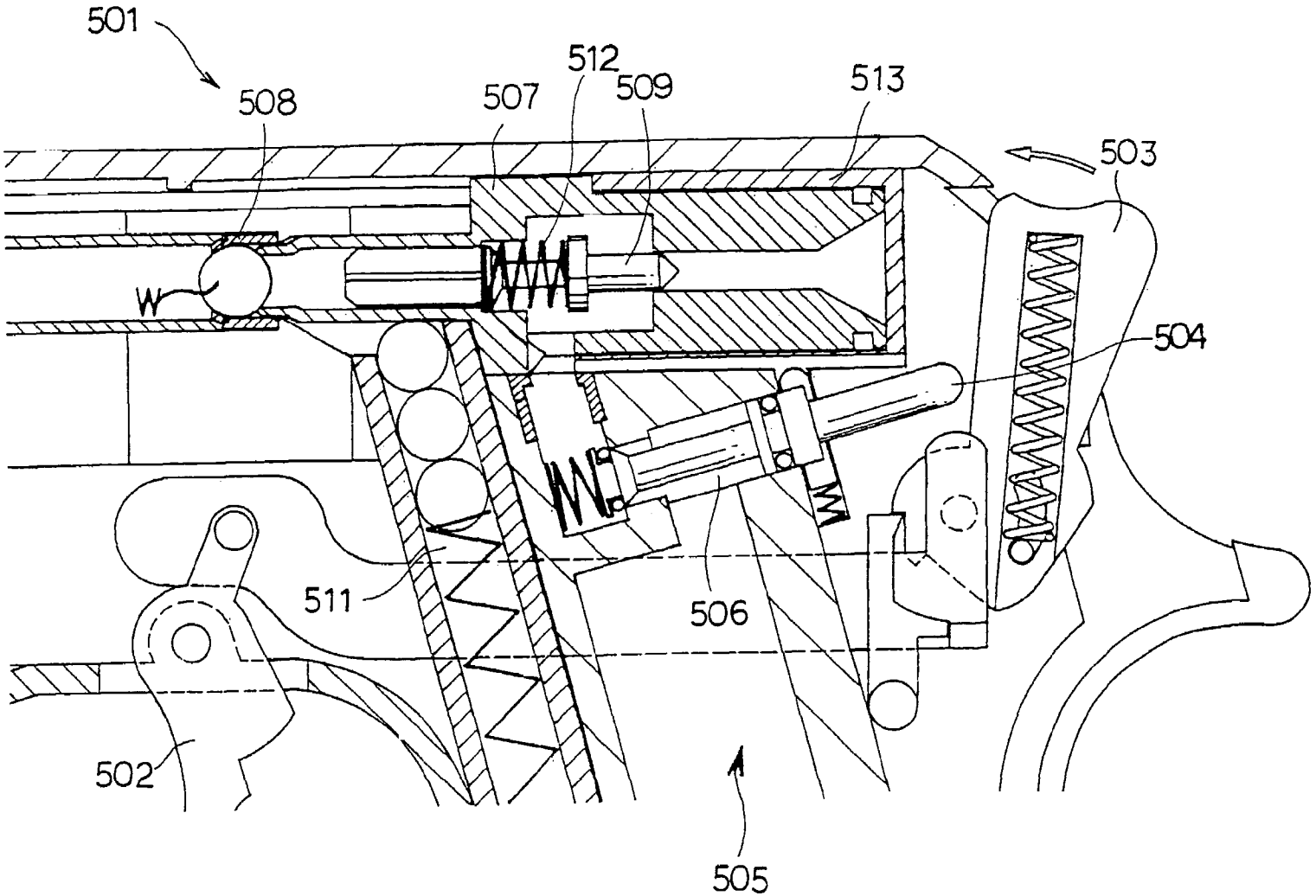
Related Art Fig.23
FIG. 23 is an explanatory drawing of related art 2.
Figure 24:
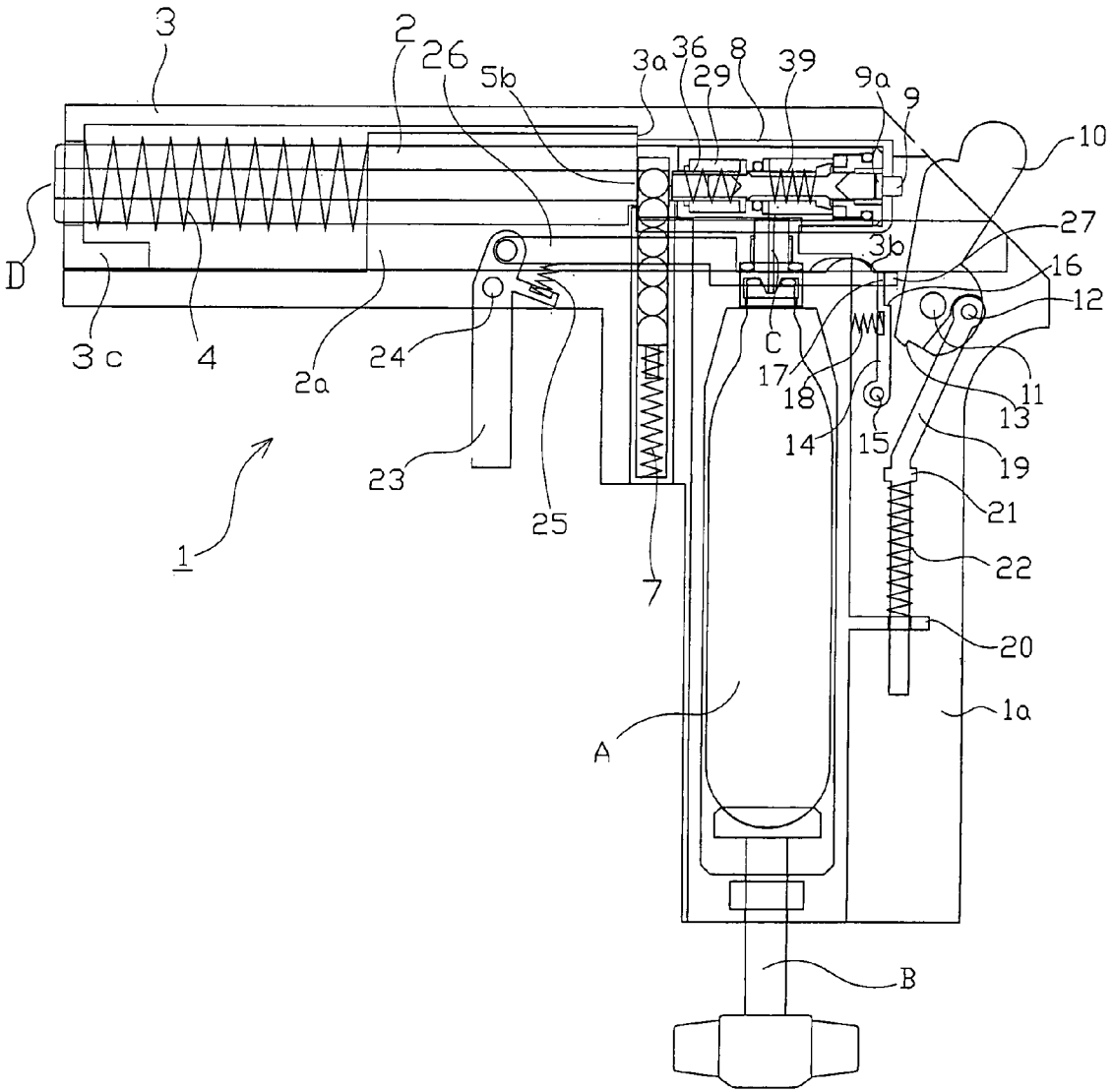
Related Art Fig.24
FIG. 24 is an explanatory drawing of related art 3.

Then, since the slide 13 has been moved as far as possible to the gun rear end side, it is again returned to the muzzle D side by the urging force of the slide spring 4. The state where the slide 3 has been returned to the muzzle D side is shown in FIG. 10 and FIG. 21.

Figure 10:
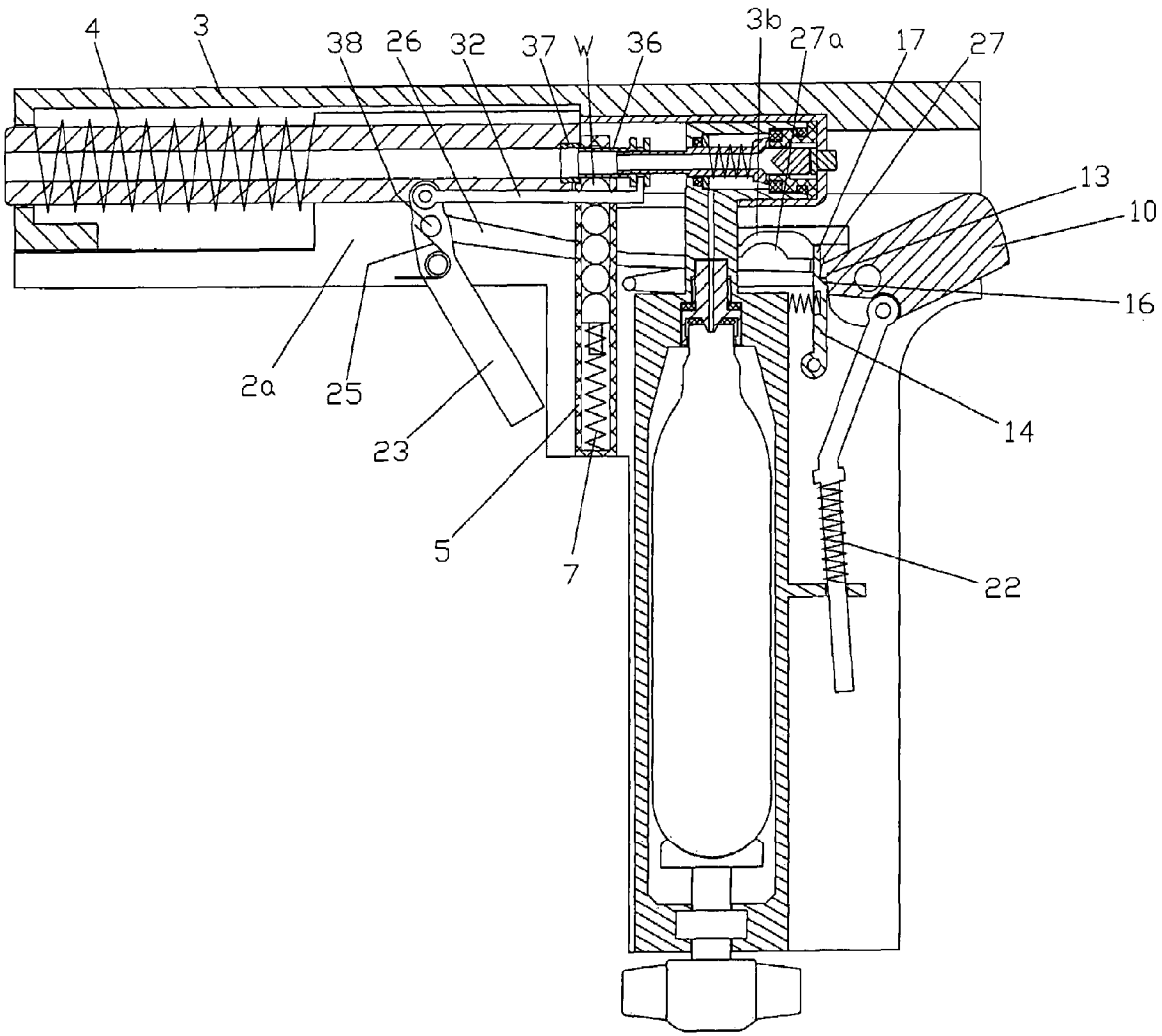
FIG. 10 is a cross sectional explanatory drawing of an operational state of the air gun of the first embodiment of this invention.

From the state shown in FIG. 3 and FIG. 14, the trigger 23 is pulled to fire the gun, the moved slide 3 moves to the gun rear end side, a successful operation to return again to the state of FIG. 10 and FIG. 21 is instantly carried out, and in the state of FIG. 10 and FIG. 21 the trigger 23 has again been pulled to the gun rear end side. As a result, since the bullet feed nozzle 36 being moved in the muzzle D direction by the bullet feed nozzle link 32 is blocking the opening 5*b* of the magazine 5, the next bullet W inside the magazine 5 can not be raised to the loadable position. Also, the engagement projection 27*a* of the trigger bar 26 has already reached the lower part of the engagement indent 3*b* of the slide 3, but the shear engagement section 27 of the trigger bar 26 is positioned at a lower part of the engagement projection of the shear 14, and can not move upwards.

In this state, of the user takes their finger off the trigger 23, the trigger 23 is returned to the muzzle D side by urging force of the trigger spring 25, and the bullet feed nozzle link 32 linked to the trigger 23 moves to the gun rear end side. The bullet feed nozzle engagement section for to the bullet feed nozzle link 26 is also moved to the gun rear end side. Therefore, the bullet feed nozzle link engagement projection 52 being engaged with the bullet feed nozzle engagement projection 51, and the bullet feed nozzle 36, also move to the gun rear end side. The opening 5*b* of the magazine 5 is opened by rearward movement of the bullet feed nozzle 36, and it is possible to load the next bullet W into the chamber 37.

At the same time, the trigger bar 26 is moved to the gun rear end side and the shear engagement projection 27 is moved to the gun rear end side by the engagement projection 17 of the shear 14, making it possible for the trigger bar 26 to move upwards, moving upwards by the urging force of the trigger spring 25, with the engagement projection 27*a* engaging with the engagement indent 3*b* of the slide 3. This state is shown in FIG. 3 and FIG. 14. Naturally, the bullet W is loaded in the magazine will be the next bullet, but preparing for the state firing the next bullet W, by pulling the trigger 23 the operations shown in FIG. 3 to FIG. 10 and in FIG. 12 to FIG. 21 are repeated, firing the next bullet, and also preparing for firing of the subsequent bullet.

In this way, By pulling the slide 3 to the gun rear end side from the state of FIG. 1 and FIG. 12, in the state where the hammer 10 has been rotated to the gun rear end side it engaged with the sear 14, and after that, it is possible to sequentially fire bullets W by pulling the trigger 32. Therefore, according to the air gun of the present invention, it is possible to carry out firing of a bullet before rearward movement of the slide starts. For this reason, since a bullet is fired before the barrel is subjected to any effect due to rearward movement of the slide, shooting precision is improved.

Also, the air gun of the present invention has a bullet feed nozzle that is operated manually, and high pressure gas does not act on the nozzle, which means that durability is improved.

What is claimed is:

1. An air gun, comprising:

a slide, provided in an upper part of a gun, capable of sliding parallel to a barrel;

a cylinder portion, formed of a cylinder that is open at a muzzle side and closed off a gun rear end side, fixed to a gun rear end side of the slide;

a hit pin provided projecting from a hollow inner portion of the cylinder portion to a gun rear end side, and capable of sliding in a nozzle direction, a hollow valve pin chamber fixed to the gun body so as to be positioned in the hollow inner portion of the cylinder portion;

a valve body having a first through hole passing through from a muzzle side to a gun rear end side at a smaller diameter than the valve pin chamber, the first through hole comprises a muzzle side through hole and a rear end side through hole;

a gas supply port, opened to a cylindrical peripheral surface of the valve pin surface, for normally supplying compressed gas to the valve pin chamber of the valve body;

a valve pin, formed as a cylinder having a second through hole, provided inside the valve pin chamber, urged normally to the gun rear end side and having a bullet feed nozzle insertion section formed at a muzzle side, and inserted into the muzzle side through hole of the valve pin chamber to project, and a pin body having a valve pin flange section, capable of sliding in an air-tight state with the muzzle side through hole of the valve pin chamber, and contacting a gun rear end side surface of the valve pin in an air-tight manner at the gun rear end side, wherein the valve pin communicates with a muzzle side providing a valve pin chamber side opening that opens to a pin body side surface at a muzzle side of a pressing section provided in the pin body;

a pressing section, provided at a gun rear end side of the pin body, fixed to the valve body, inserted into a rear end side of the second through hole to project, positioned so that a tip end of a gun rear side of the pressing section is adjacent to the hit pin, and capable of passing compressed gas from a clearance between the rear end side of the second through hole;

a bullet feed nozzle link connected to a trigger; and a bullet feed nozzle, formed as a cylinder, inserted into a bullet nozzle insertion section of a valve pin nozzle side projecting to a nozzle side of the valve pin chamber, forming a rib-shaped bullet feed nozzle link engagement projection for engaging with the bullet feed nozzle link at an outer periphery of a gun rear end side, and being capable of sliding in the valve pin muzzle side bullet feed nozzle insertion section in order to load a bullet in the chamber in response to movement of the trigger and the bullet feed nozzle link, wherein when the hit pin is pressed to the muzzle side and made to slide to the muzzle side, the valve pin slides to the muzzle side against urging force to release an airtight state between the valve pin flange section and the gun rear end side side surface of the valve pin chamber, compressed gas supplied to the valve pin chamber from the gas supply port is supplied from between the valve pin chamber gun rear end side side surface and the valve pin flange section to the valve pin chamber side opening, and a bullet is fired from the muzzle by passing compressed gas through the bullet feed nozzle insertion section to the muzzle side of the bullet feed nozzle, and compressed gas is supplied from a clearance between the pressing section and the rear end side of the second through hole into which the pressing section is inserted to the gun rear end side to cause the cylinder section to move to the gun rear end side.

* * * * *